US010156234B2

(12) United States Patent
Quiros Morales

(10) Patent No.: US 10,156,234 B2
(45) Date of Patent: Dec. 18, 2018

(54) HYDROSTATIC ENERGY GENERATOR

(71) Applicant: Luis Fernando Quiros Morales, Medellin (CO)

(72) Inventor: Luis Fernando Quiros Morales, Medellin (CO)

( * ) Notice: Subject to any disclaimer, the term of this patent is extended or adjusted under 35 U.S.C. 154(b) by 679 days.

(21) Appl. No.: 14/410,779

(22) PCT Filed: Jun. 26, 2013

(86) PCT No.: PCT/IB2013/001359
§ 371 (c)(1),
(2) Date: Dec. 23, 2014

(87) PCT Pub. No.: WO2014/001881
PCT Pub. Date: Jan. 3, 2014

(65) Prior Publication Data

US 2015/0192017 A1 Jul. 9, 2015

(30) Foreign Application Priority Data

Jun. 28, 2012 (EP) ..... 12174154

(51) Int. Cl.
*F04B 53/14* (2006.01)
*F04B 1/02* (2006.01)
(Continued)

(52) U.S. Cl.
CPC ..... *F04B 53/148* (2013.01); *F01B 23/10* (2013.01); *F04B 1/02* (2013.01); *F04B 9/1172* (2013.01);
(Continued)

(58) Field of Classification Search
CPC ..... F04B 9/109; F04B 9/111; F04B 9/113; F04B 25/005; F04B 5/00; F04B 1/02;
(Continued)

(56) References Cited

U.S. PATENT DOCUMENTS 445,412 A * 1/1891 Royce ..... F04B 5/02 417/531
4,068,476 A 10/1978 Kelsey
(Continued)

FOREIGN PATENT DOCUMENTS

DE 30 32 430 A1 3/1982
FR 2 517 738 A1 6/1983

OTHER PUBLICATIONS

International Preliminary Report on Patentability on PCT/IB2013/001359 dated Jan. 8, 2015.

*Primary Examiner* — Bryan Lettman
(74) *Attorney, Agent, or Firm* — Kelly & Kelley, LLP

(57) ABSTRACT

A hydrostatic energy generator includes at least a first chamber and a second chamber, wherein the first chamber and the second chamber are at least partially filled with a fluid in order to exploit hydrostatic energy, such as for instance static or hydrostatic pressure or head, to generate and deliver energy, such as hydraulic energy, electrical energy, or mechanical energy. A first piston is movably arranged within the first chamber and a second piston is movably arranged within the second chamber, wherein the first piston is mechanically or hydraulically connected to the second piston. The first chamber includes a first passageway for inlet and/or discharge of the fluid and a second passageway for inlet and/or discharge of the fluid. The second chamber includes a third passageway for inlet and/or discharge of the fluid and a fourth passageway for inlet and/or discharge of the fluid.

10 Claims, 11 Drawing Sheets

(51) Int. Cl.

| | |
|---|---|
| ***F04B 25/00*** | (2006.01) |
| ***F04B 9/117*** | (2006.01) |
| ***F15B 21/14*** | (2006.01) |
| ***F01B 23/10*** | (2006.01) |
| *F15B 3/00* | (2006.01) |

(52) U.S. Cl.
CPC ..... *F04B 25/005* (2013.01); *F15B 21/14* (2013.01); *F15B 3/00* (2013.01); *F15B 2211/7055* (2013.01)

(58) Field of Classification Search
CPC ..... F04B 5/02; F04B 27/005; F04B 27/02; F04B 53/148; F04B 9/117; F04B 9/1172
See application file for complete search history.

(56) References Cited

U.S. PATENT DOCUMENTS

| | | | | |
|---|---|---|---|---|
| 4,229,143 | A * | 10/1980 | Pucher | F04B 9/1035 417/383 |
| 4,765,144 | A | 8/1988 | Spacer | |
| 2013/0014834 | A1 * | 1/2013 | Yang | E02B 11/00 137/395 |

* cited by examiner

HYDROSTATIC ENERGY GENERATOR

BACKGROUND

Various Systems exist to generate energy, such as for instance electrical energy, which are using energy sources such as for instance wind power, solar energy, or water current as a primary source. However, there is no commercial system available, which can generate energy based on hydrostatic energy source, such as a hydrostatic pressure or head.

DESCRIPTION OF THE INVENTION

Object

The aim of the present invention is to provide a device and a method for exploiting hydrostatic energy, such as for instance static or hydrostatic pressure or head, to generate and deliver energy, such as for instance hydraulic energy, electrical energy, or mechanical energy. It is further the aim of the invention, to provide a device with a relatively simple and economic structure to be used in a commercial energy generation system. Wherein in the following pressure or hydrostatic potential is meant by head. Static pressure or hydrostatic pressure or head is the pressure exerted by a fluid on a body when the body is at rest relative to the fluid.

Solution

According to the invention, a device for exploiting hydrostatic energy is suggested, wherein the device comprises at least a first chamber and a second chamber, wherein the first chamber and the second chamber are at least partially filled with a fluid. Furthermore, the inventive device comprises a first piston moveably arranged within the first chamber and a second piston moveably arranged within the second chamber, wherein the first piston is mechanically or hydraulically connected to the second piston, wherein the first chamber comprises at least a first means or passageway for inlet and/or discharge of the fluid and a second means or passageway for inlet and/or discharge of the fluid, wherein the second chamber comprises at least a third means or passageway for inlet and/or discharge of the fluid and a fourth means or passageway for inlet and/or discharge of the fluid.

By a means for inlet, it is to be understood that the fluid can enter the according chamber through this means or passageway. By means for discharge it is to be understood that the fluid can exit the according chamber through this means or passageway. Therefore, discharge stands for outlet.

The first chamber and the second chamber can in principle be designed in any shape. For instance the two chambers can have an angular, or a cylindrical shape. For example, the first chamber and/or the second chamber comprise a circular, elliptical, rectangular, quadratic or other cross section. Furthermore, the two chambers can have equal or a different shape. Each piston arranged in the according chamber comprises the same principal shape as the according chamber. It is preferred, that the two chambers have a different size. For example, the second chamber can have a larger size than the first chamber and therefore comprises a larger volume than the first chamber.

The first piston is connected to the second piston by any appropriate mechanical or hydraulic connection means. The two means for inlet and/or discharge of the fluid at each of the two chambers can be any appropriate means for inlet and/or discharge of a fluid. For instance these means for inlet and/or discharge of the fluid can consist of pipes, holes drilled through the chamber wall or others. The fluid within each of the chambers can be any kind of fluid. For instance the fluid can be a liquid, such as water, oil, petroleum, or any other kind of appropriate liquid. Furthermore, the fluid can be gaseous. For instance, the fluid within each of the two chambers can be air, oxygen or any other kind of appropriate gas. Furthermore, the fluid can be compressible or incompressible, Newtonian or non-Newtonian, pure substances or mixtures. Even if not necessary, it is preferred, that each chamber is at least partially filled with the identical fluid.

The inventive device can be arranged in any appropriate way. For instance, the inventive device can be arranged in such a way that the two chambers are arranged one above the other. Furthermore, it is possible to arrange the two chambers next to one another. Furthermore, it is possible to connect both chambers with each other. Furthermore it is possible to arrange both chambers in a distance to each other, wherein the distance between the two chambers comprises a free space or a space filled with any appropriate material.

Preferably, at least one means for inlet and/or discharge of the fluid is connected to a supply source, e.g. a static pressure, a hydrostatic pressure or head source. For example the one means for inlet and/or discharge of the fluid is supplied with a pressure existing on a certain depth or water level within a tank, lake or any other arrangement filled with a fluid, e.g. water, air or other. Additionally, it is possible to connect this means for inlet and/or discharge of the fluid to a pressure tank or pressure vessel, e.g. a pressurized hydropneumatic tank. Any other kind of fluid can be used as well. The incoming hydrostatic pressure will then cause the piston arranged within the according chamber to move up and/or down or back and/or forwards. In order to ensure a continuous reciprocating movement of the piston, the means for inlet and/or discharge of the fluid can be controlled, for instance be opened or closed, in any appropriate way. The reciprocating movement of the pistons can be used to generate any kind of energy. For instance the movement of the pistons can be used to generate a hydraulic energy, in particular an increased pressure or head. The movement of the pistons can be used to generate mechanical or electrical energy. Energy can also be generated from any single or individual stroke of the first piston and/or the second piston. However, a reciprocating movement is preferred.

It is preferred, that the first piston splits up the interior of the first chamber into a first volume and a second volume and wherein the first means or passageway for inlet and/or discharge of the fluid is allocated to the first volume and wherein the second means or passageway for inlet and/or discharge of the fluid is allocated to the second volume and wherein the second piston splits up the interior of the second chamber into a third volume and a fourth volume and wherein the third means or passageway for inlet and/or discharge of the fluid is allocated to the third volume and wherein the fourth means or passageway for inlet and/or discharge of the fluid is allocated to the fourth volume. Preferably, each volume or space is fully or completely filled with the fluid. The size of each volume or space, within each chamber varies during operation of the inventive device due to the reciprocating movement of the first and second piston. It is preferred that the stroke or distance of each movement is identical for the first and the second piston.

The first piston can be connected to the second piston by any appropriate connection means. Therefore, the first piston can move in an opposite direction to the movement of the second piston. However, it is preferred that the first piston is connected to the second piston in such a way, that both pistons move synchronously to each other and in the same direction with each stroke. It is further preferred, that the first volume or space within the first chamber and the third volume or space within the second chamber are decreased or increased at the same point of time due to the movement of the first piston and the second piston.

Each means for inlet and/or discharge of the fluid is arranged at an end region of the volume this means is allocated to. For example, the first means for inlet and/or discharge of the fluid is arranged at a first front side of the first chamber or at a side wall of the first chamber close to the first front side of the first chamber or at the corner region between the first front side of the first chamber and a side wall of the first chamber. Therefore, each means for inlet and/or discharge of the fluid is arranged in such a way, that it is not covered by a piston during its movement.

It is further preferred that the first chamber comprises a fifth means or passageway for inlet and/or discharge of the fluid and a sixth means or passageway for inlet and/or discharge of the fluid and wherein the second chamber comprises a seventh means or passageway for inlet and/or discharge of the fluid and an eighth means or passageway for inlet and/or discharge of the fluid. Preferably always two means for inlet and/or discharge of the fluid are allocated to an identical volume. For example, the first and the fifth means or passageways of inlet and/or discharge of the fluid are both allocated to the first volume, and the second and sixth means or passageways for inlet and/or discharge of the fluid are both allocated to second volume, and the third and seventh means or passageways for inlet and/or discharge of the fluid are both allocated to third volume, and the fourth and eighth means or passageways for inlet and/or discharge of the fluid are both allocated to the fourth volume.

Additionally, the device preferably comprises a first tank, wherein the first tank is connected by a connection means to the first means for inlet and/or discharge of the fluid and/or that the first tank is connected by a connection means to the second means for inlet and/or discharge of the fluid and/or that the first tank is connected by a connection means to the third means for inlet and/or discharge of the fluid and/or that the first tank is connected by a connection means to the fourth means for inlet and/or discharge of the fluid and/or that the first tank is connected by a connection means to the fifth means for inlet and/or discharge of the fluid and/or that the first tank is connected by a connection means to the sixth means for inlet and/or discharge of the fluid and/or that the first tank is connected by a connection means to the seventh means for inlet and/or discharge of the fluid and/or that the first tank is connected by a connection means to the eighth means for inlet and/or discharge of the fluid. The first tank can be used as an auxiliary tank for temporary collecting or storing the fluid. Appropriate connection means for connecting the first tank with any of the means for inlet and/or discharge of the fluid can be any connection means appropriate for moving the fluid. For example, pipes can be used as connection means which allow the fluid, e.g. water, to move or flow from and/or to the first tank.

The first tank can be arranged next to the first chamber and/or next to the second chamber. Furthermore, the first tank can be arranged above the first chamber and/or above the second chamber. The first tank can be any appropriate repository, bin or container. Furthermore, the first tank can consist of any possible shape. Additionally, the first tank can be opened or closed. Preferably, the pressure within an opened or closed first tank is in the range of the atmospheric pressure, for example within the range of the atmospheric air pressure. The first tank can be located close to the inventive device or at a certain distance to the inventive device. It is further possible to locate the first tank far away, for example multiple meters or kilometers, away from the inventive device.

It is further preferred that the first tank is at least partially arranged around the first chamber and/or around the second chamber. The first tank can comprise separate walls. It is further possible that the outer wall of the first chamber or the second chamber is used as a wall for the first tank.

Preferably, at least one means for inlet and/or discharge of the fluid is connected to a supply source, e.g. a static pressure, a hydrostatic pressure or head source. For this reason, this means for inlet and/or discharge of the fluid is supplied with a higher pressure compared with the pressure in the first tank of the device, e.g. pressure in the first tank could be the atmospheric pressure, or pressure in the first tank could be higher or lower than the atmospheric pressure. For example the one means for inlet and/or discharge of the fluid is supplied with a pressure existing on a certain depth or water level within a tank, lake or any other arrangement filled with a fluid, e.g. water, or it can be supplied with atmospheric pressure, e.g. the atmospheric air pressure, if the first tank comprises enough vacuum pressure.

Additionally the device comprises a manual or automatic control system in particular, valves or an automatic hydraulic directional valve. A valve can be arranged at or within the means for inlet and/or discharge of the fluid. Furthermore, the valves can be arranged within or at the connection means. The control system, e.g. the valves, is used to control the flow of the fluid and in particular the direction of the flow of the fluid through each of the means for inlet and/or discharge of the fluid. Furthermore the control system, e.g. valves, is used to stop and/or initiate the flow or movement of the fluid through a means for inlet and/or discharge of the fluid. The control system can for example set a certain configuration for all means for inlet and/or the discharge of the fluid at any certain point of time. For example, at a point of time the first means for inlet and/or discharge of the fluid can be configured or activated for inlet, wherein the second means for inlet and/or discharge of the fluid is configured or activated for discharge or outlet, and wherein the third means for inlet and/or discharge of the fluid is configured or activated for inlet, and wherein the fourth means for inlet and/or discharge of the fluid is configured or activated for discharge or outlet. Valves used for the control system can consist of any appropriate type of valves. For example such valves can be check valves, or any type of shut off valves, e.g. gate, ball, butterfly, globe or membrane valves, or combination of some of these valves.

That at least two means for inlet and/or discharge of the fluid are connected by connection means wherein the connection means or preferably comprising pipes and/or holes internally drilled inside and along the chamber walls. The pipes can consist of flexible or non-flexible pipes. Furthermore, the pipes can consist of a combination of flexible and non-flexible pipes. Holes which are internally drilled inside and along the chamber walls can be arranged along the entire length of a wall of the first chamber and/or the second chamber. Furthermore it is possible, that the holes internally drilled inside and along the chamber walls are arranged along a part of the length of the first chamber and/or the second chamber. It is also possible, that the chamber walls are consisting of a double-walled arrangement, wherein the space between the two walls of the double-walled arrangement is used as the connection means.

Preferably, at least one of the means for inlet and/or discharge of the fluid allocated to the first volume is connected to at least one of the means for inlet and/or discharge of the fluid allocated to the fourth volume. Furthermore it is preferred that at least one of the means for inlet and/or discharge of the fluid allocated to the third volume is connected to at least one of the means for inlet and/or discharge of the fluid allocated to the second volume. The word "connected" means that the fluid can flow or move through the connection means. The flow of the fluid can be controlled and/or stopped or interrupted by the control system, e.g. valves within or at the pipes.

It is further preferred, that the first piston comprises a first front side with a first surface area and wherein the first piston comprises a second front side with a second surface area and wherein the first surface area is larger than the second surface area and wherein the second piston comprises a third front side with a third surface area and a fourth front side with a fourth surface area, and wherein the fourth surface area is larger than the third surface area. It is further preferred that the fourth surface area of the second piston is larger than the first surface area of the first piston. It is further preferred that the third surface area of the second piston is larger than the second surface area of the first piston.

Therefore it is preferred, that each front side of the first piston comprises a larger and a smaller surface area. Furthermore, it is preferred that each front side of the second piston comprises a larger and a smaller surface area. Therefore, each piston comprises two front sides with different surface areas in size. It is further preferred, that the connection means used to mechanically or hydraulically connect the first piston with the second piston is connected to a front side of the first piston and to a front side of the second piston. For instance, the connection means can be a bar, or a rod. Due to the connection area or interface area needed for connecting such a connection means, e.g. rod, at one of the front sides of a piston, the remaining and effective surface area of this front side is reduced. The surface area of a front side of a piston is the contact area between the fluid and the according front side of the piston. Therefore, the hydrostatic pressure, e.g. the energy source for the inventive device, can be applied to different surface areas of a piston.

Since both pistons are connected to each other, the same force is applied to each piston during movement of the two pistons. However, since the surface areas of each front side of a piston are different, a higher pressure is obtained in the side of the chamber with a smaller surface area of the front side of the piston. Therefore, the pressure in the first volume of the first chamber can be different to the pressure in the second volume of the first chamber during movement of the first piston. Furthermore, the pressure within the third volume of the second chamber is different to the pressure in the fourth volume of the second chamber during movement of the second piston. Furthermore, since the fourth surface area of the second piston is larger than the first surface area of the first piston, the pressure in the first volume of the first chamber can be different from the pressure in the fourth volume of the second chamber during movement of the first and the second piston. Furthermore, since the third surface area of the second piston is larger than the second surface area of the first piston, the pressure in the second volume of the first chamber can be different from the pressure in the third volume of the second chamber during movement of the first and the second pistons. The advantage of heaving different surface or contact areas at each front side of the pistons is that high forces and high discharge pressures can be advantageously generated at the same time.

Preferably the connection means for connecting the first piston with the second piston comprises at least two sectional areas with different diameters. For example, the connection means for connecting the first piston with the second piston can comprise the shape of a rod. The rod could, or could not, contain two sectional areas, a first rod sectional area and a second rod sectional area, wherein the first rod sectional area is connected to the second front side of the first piston, and the second rod sectional area is connected to the third front side of the second piston, wherein the diameter of the rod at the first rod sectional area is smaller than the diameter of the rod at the second rod sectional area. The advantage of applying a connection means, e.g. a rod, for connecting the first piston with the second piston, wherein the connection means comprises two sectional areas with different diameters, is that special constraints, such as preferred ratios between the four different surface areas of each front side of a piston and preferred ratios between the volumes within the two chambers, can be achieved. The special constraints to be achieved are:

a) the first surface area of the first piston is larger than the second surface area of the first piston, and
b) the fourth surface area of the second piston is larger than the third surface area of the second piston, and
c) the fourth surface area of the second piston is larger than the first surface area of the first piston, and
d) the third surface area of the second piston is larger than the second surface area of the first piston, and
e) to avoid leaks from the Hydrostatic Energy Generator, the fourth volume of the second chamber is equal to the sum of the first volume of the first chamber plus the second volume of the first chamber.

It is preferred, that a means for sealing, e.g. a set of O-rings, is arranged between the first piston and the wall of the first chamber and between the second piston and the wall of the second chamber.

It is further preferred, that a means for sealing, e.g. a set of O-rings, is arranged between the connection means, e.g. rod, for connecting the first piston with the second piston, and a chamber wall of the first chamber and between this connection means and a chamber wall of the second chamber.

It is further possible, that the increased discharge pressure is discharged or provided into a pressure tank, e.g. a pressurized hydro-pneumatic tank.

Furthermore, a pressure tank, e.g. a pressurized hydro-pneumatic tank, can be used as the source of incoming hydrostatic pressure. This hydrostatic pressure has in this case been previously charged in the hydro-pneumatic tank by using for example pressurized air. Since discharge pressure is significantly higher than the hydrostatic pressure in the hydro-pneumatic tank, the discharged flow can be easily injected back into the hydro-pneumatic tank. This means, that only a very small part of the total discharged energy is taken to inject this flow back. The remaining energy (which is the higher part) is then available to be utilized to carry out any specific work.

Mentioned pressure tanks, e.g. hydro-pneumatic tanks, could include, or could not, a flexible membrane to internally separate pressurized air from internal liquid (for example water), to avoid air leakage through the liquid itself, and thus optimizing the system.

Two or more devices can be connected in series. Series connections can be used to increase the discharge pressure over the discharge pressure of only one device. Furthermore, two or more devices can be connected in parallel. Parallel connections can be used to increase the discharge flow over the discharge flow of only one device.

Combination of one or more devices connected in series with one or more devices connected in parallel can be used to achieve any determined hydraulic result (increased head and/or increased flow).

According to the invention, an automatic hydraulic directional valve specially designed as part of the invention, in particular to be used for a device for exploiting hydrostatic energy is further preferred to provide automatic control for the different means for inlet and/or discharge of the fluid.

It is preferred that the automatic hydraulic directional valve comprises at least a third piston, wherein the automatic hydraulic directional valve is connected to the first means for inlet and/or discharge of the fluid and to the second means for inlet and/or discharge of the fluid and to the third means for inlet and/or discharge of the fluid and to the fourth means for inlet and/or discharge of the fluid to control the flow direction of the fluid to and from the first volume, the second volume, the third volume, and the fourth volume.

According to the invention a method for exploiting hydrostatic energy with a device in particular according to claims 1 to 9 is further suggested, wherein the device comprises a first chamber and a second chamber, wherein the first chamber and the second chamber are at least partially filled with a fluid, a first piston movably arranged within the first chamber and a second piston movably arranged within the second chamber, wherein the first piston is mechanically or hydraulically connected to the second piston by connection means, wherein the first chamber comprises at least a first means for inlet and/or discharge of the fluid and a second means for inlet and/or discharge of the fluid, wherein the second chamber comprises at least a third means for inlet and/or discharge of the fluid and a fourth means for inlet and/or discharge of the fluid, wherein the first piston splits up the interior of the first chamber into a first volume and a second volume, wherein the first means for inlet and/or discharge of the fluid is allocated to the first volume and wherein the second means for inlet and/or discharge of the fluid is allocated to the second volume and wherein the second piston splits up the interior of the second chamber into a third volume and a fourth volume, wherein the third means for inlet and/or discharge of the fluid is allocated to the third volume and wherein the fourth means for inlet and/or discharge of the fluid is allocated to the fourth volume, wherein the method comprises the following steps:

a) activating the fourth means for inlet and/or discharge of the fluid to let the fluid flow into the second chamber to increase the fourth volume, and b) activating the third means for inlet and/or discharge of the fluid to let the fluid at least partially flow out of the second chamber to decrease the third volume, and c) activating the second means for inlet and/or discharge of the fluid to let the fluid flow into the first chamber to increase the second volume, and d) activating the first means for inlet and/or discharge of the fluid to let the fluid at least partially flow out of the first chamber to decrease the first volume, wherein a pressure difference between the first volume and the second volume of the first chamber and/or between the third volume and the fourth volume of the second chamber and/or between the fourth volume of the second chamber and the first volume of the first chamber, and/or between the third volume of the second chamber and the second volume of the first chamber is generated to move the first piston and the second piston, wherein hydraulic energy, in particular an increased pressure or head, mechanical energy or electrical energy is generated.

It is preferred that, after performing steps a) to d) and after the first piston and the second piston have moved, the activation of the means for inlet and/or discharge of the fluid is reverted or other means are activated to move the first piston and the second piston in the reverse direction within each chamber. Before reverting the means for inlet and/or discharge of the fluid, it is preferred that all means are closed for a certain, preferably small, period of time. Instead of reverting the means for inlet and/or discharge of the fluid, other means preferably additional means or a combination of additional means and the first and/or the second and/or the third and/or the fourth means for inlet and/or discharge of the fluid can be activated in such a manner to move the first piston and the second piston back to their previous positions.

It is further preferred, that the activation of the means for inlet and/or discharge of the fluid is continuously reverted or activated in time intervals, preferably in regular time intervals, to generate a reciprocating movement of the first piston and the second piston. The time interval for reverting or activating the means for inlet and/or discharge of the fluid is at least that large to guarantee that the first piston and the second piston have stopped or completed the movement into one direction. It is further preferred, that a control unit or system is used which checks that the movement of both pistons into one direction is completed and that a predefined time interval has elapsed. Therefore, based on the position of both pistons and the time elapsed within an interval, the means of inlet and/or discharge of the fluid are reverted or activated to move the two pistons into the reverse direction compared with their previous movement.

Preferably, one of the means for inlet and/or discharge which is activated to let the fluid into the first chamber or into the second chamber is applied to a static pressure source. The static pressure source is used as an inlet pressure source. Therefore, one of the means can be connected to a pressure tank or pressure vessel, e.g. an hydro-pneumatic-tank. Alternatively, one of the means can be opened for inlet of the fluid, while the device or at least the according chamber is exposed to a certain hydrostatic pressure. For example, the device can be arranged at a certain depth within a water tank, wet well, lake, ocean, etc.

It is additionally preferred, that the fluid which flows at least partially out of the second chamber to decrease the fourth volume is at least partially flowing into the first chamber while increase the first volume and/or into a first tank for temporarily storing the fluid, and/or that the fluid which flows at least partially out of the second chamber to decrease the third volume is at least partially flowing into a second tank for discharging the fluid or pressure, and/or that the fluid flows at least partially into the first chamber to increase the second volume and/or from a first tank taking the volume previously and temporarily stored and/or the fluid flows out of the first chamber to decrease the first volume and flows to the second tank for discharging the fluid or pressure. It is preferred, that the second means for inlet and/or discharge of the fluid is connected with the third means for inlet and/or discharge fluid so that the fluid can move or flow from one of the two means for inlet and/or discharge of the fluid to the other and vice versa.

Furthermore, it is preferred, that electrical or mechanical energy is generated by using an increased discharge pressure of the fluid letting out of the first chamber and/or the second chamber by driving means for mechanical operation, or by driving means for electrical energy generation, in particular a turbine and/or generator. For example, one or multiple means for inlet and/or discharge of the fluid can be connected to a first or second tank for discharging the outlet pressure. The fluid exits the first chamber or the second chamber at a higher pressure level compared with the inlet pressure source. The higher discharge pressure can be used to pump or lift the fluid up to a certain height into a discharge tank. The discharge tank can be opened in order for the fluid to exit and to drive a turbine and/or a generator.

Preferably, mechanical energy is generated by connecting driving means for mechanical operation, in particular a fly-wheel, to the first piston and/or to the second piston and/or to a connection means connecting the first piston to the second piston. In this case, the incoming hydrostatic pressure, once in the interior of the device, and due to differences in surface areas of each piston, moves the interior pistons up and down or back-and-forth (in a reciprocating movement) which is converted into rotational movement. The driving means, e.g. the fly-wheel can be used to store rotational energy and/or to stabilize rotational speed and/or to generate mechanical energy. The mechanical energy generated can be used to move any machine in any application. Examples of such machines or applications are cars, automobiles, trucks, ships, submarines, trains, airplanes, airships, helicopters, space shuttles, aerospace vehicles, etc. In these cases the hydrostatic energy generator would replace any engine, turbine or prime mover for these vehicles.

It is also preferred, that electrical energy is generated by producing a changing magnetic field based on the reciprocating movement of the first piston and/or the second piston. This configuration of the device is based on the Faraday's Law of electromagnetic induction, which applies to the production of electric current across a conductor moving through a magnetic field. This law states that "the electromotive force (EMF) around an electric closed path is proportional to the rate of change of the magnetic flux through any surface bounded by that path". In other words "an electric current will be induced in any closed circuit when the magnetic flux through a surface bounded by the conductor changes". This applies whether the field itself changes in strength or the conductor is moved through it. The incoming hydrostatic pressure, once in the interior of the device, due to differences in surface areas of each piston, moves the interior pistons up and down or back-and-forth (in a reciprocating movement). This movement is then used to produce the necessary changing magnetic field to produce electric energy.

The invention will now be described with reference to the figures based on preferred embodiments of the invention.

PREFERRED EMBODIMENTS OF THE INVENTION

Figure 1A:
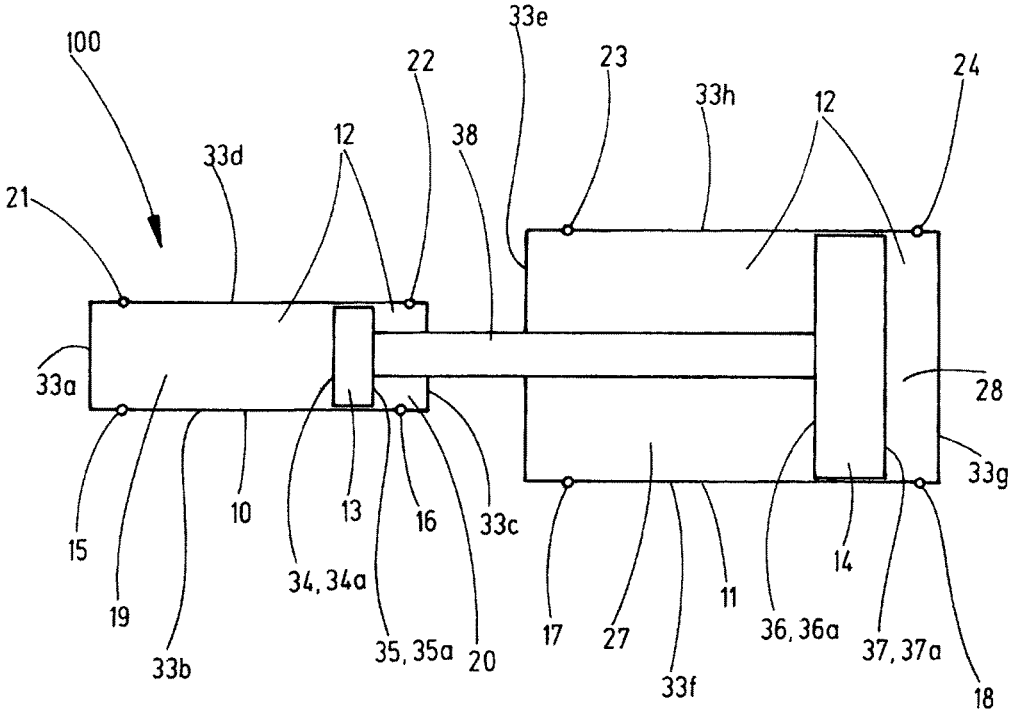
FIG. 1*a* shows the basic arrangement of the device for exploiting hydrostatic energy.

FIG. 1*a* shows the basic arrangement of the device for exploiting hydrostatic energy. The device comprises a first chamber 10 and a second chamber 11. A first piston 13 is moveably arranged within the first chamber 10 and a second piston 14 is moveably arranged within the second chamber 11. The first piston 13 is mechanically connected to the second piston 14 by a stamp, rod 38, or pipe or any other appropriate connection means. The first piston 13 splits the entire volume within the first chamber 10 into a first volume 19 and a second volume 20. A first means 15 for inlet and/or discharge of the fluid 12 is allocated to the first volume 19 of the first chamber 10. A second means 16 for inlet and/or discharge of the fluid 12 is allocated to the second volume 20 of the first chamber 10. Furthermore the second piston 14 splits up the entire volume within the second chamber 11 into a third volume 27 and fourth volume 28. A third means 17 for inlet and/or discharge of the fluid 12 is allocated to the third volume 27 of the second chamber 11 and a fourth means 18 for inlet and/or discharge of the fluid 12 is allocated to the fourth volume 28 of the second chamber 11. In this basic arrangement of a device of exploiting hydrostatic energy, the four means 15, 16, 17, 18 for inlet and/or discharge of the fluid 12 consist of holes drilled through the chamber walls. Pipes can be connected to each of the four means 15, 16, 17, 18 for inlet and/or discharge of the fluid 12. As shown in FIG. 1*a*, the device 100 for exploring hydrostatic energy can further comprise additional means 21, 22, 23, 24 for inlet and/or discharge of the fluid 12. FIG. 1*a* shows a device 100 with always two means 15, 16, 17, 18, 21, 22, 23, 24 for inlet and/or discharge of the fluid 12 allocated to each of the four volumes 19, 20, 27, 28. Each means 15, 16, 17, 18, 21, 22, 23, 24 for inlet and/or discharge of the fluid 12 is arranged at a chamber wall 33*a*, 33*b*, 33*c*, 33*d*, 33*e*, 33*f*, 33*g*, 33*h* in an area close to one of the front sides 33*a*, 33*c*, 33*e*, 33*g* of each of the two chambers 10, 11. The means 15, 16, 17, 18, 21, 22, 23, 24 for inlet and/or discharge of the fluid 12 can also be arranged at the front sides 33*a*, 33*c*, 33*e*, 33*g* of each chamber 10, 11 instead at the chamber walls close to the front sides of each chamber 10, 11.

The first piston 13 contains a first front side 34 with a larger surface area 34*a* than the surface area 35*a* of the second front side 35 of the first piston 13. The second piston 14 contains a first front side 36 with a smaller surface area 36*a* than the surface area 37*a* of the second front side 37 of the second piston 14. Each piston 13, 14 contains two front sides 34, 35, 36, 37 with a different surface area 34*a*, 35*a*, 36*a*, 37*a* because the two pistons 13, 14 are mechanically connected to each other by a rod 38 which is connected at the center point of one front side 34, 35, 36, 37 of each piston 13, 14.

Figure 1B:
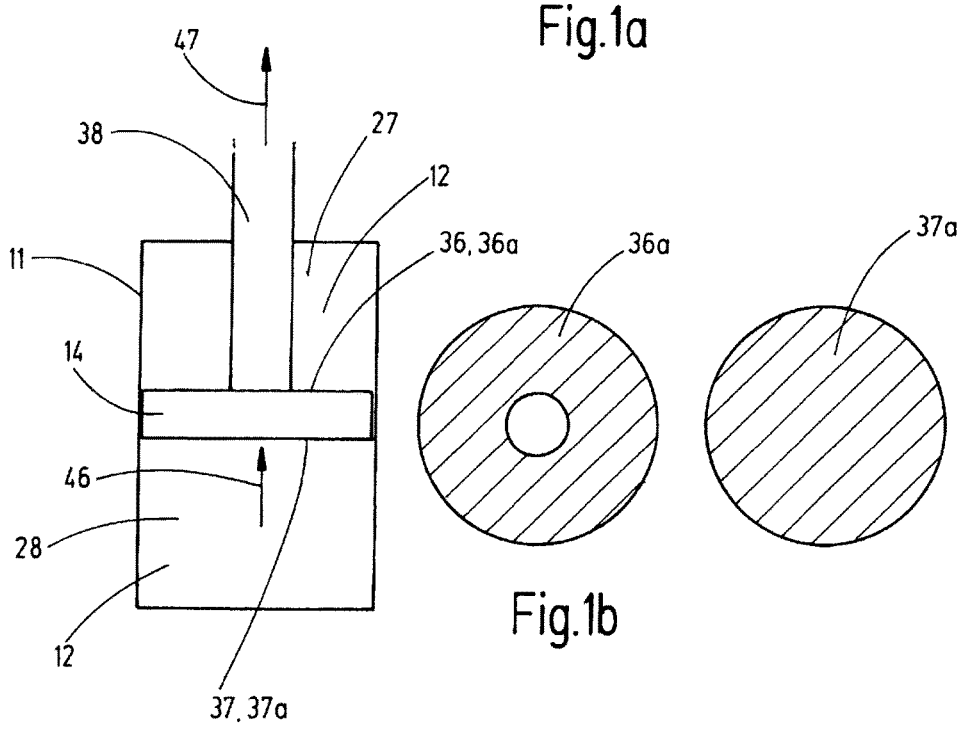
FIG. 1*b* shows the different surface areas of the second piston as an example.

FIG. 1*b* shows the different surface areas 36*a*, 37*a* of the second piston 14 as an example.

FIGS. 2*a* to 2*f* show the sequence and explain the procedure of the different steps and how the device is working as a hydrostatic energy generator. The FIGS. 2*a* to 2*f* explain in detail the sequence and the general operational procedures of such a hydrostatic generator.

In FIGS. 2*a* to 2*f*, the basic arrangement of a device 100 for exploiting hydrostatic energy based on FIG. 1 is connected to a primary hydrostatic pressure source 40 through pipes 32*a* and 32*b*. The pipe 32*a* contains a shut off valve 30*b* for controlling the third means 17 for inlet and/or discharge of the fluid 12. The pipe 32*b* contains a shut off valve 30*a* for controlling the fourth means 18 for inlet and/or discharge of the fluid 12. The first tank 25 is connected to the fifth means 21, to the second means 16, and to the eight means 24 for inlet and/or discharge of the fluid 12 through the pipe 32*c*. The pipe 32*c* contains a shut off valve 30*c* for controlling the eight means 24 for inlet and/or discharge of the fluid 12. Furthermore the pipe 32*c* contains a shut off valve 30*h* and a check valve 30*g* for controlling the second means 16 for inlet and/or discharge of the fluid 12. Furthermore the pipe 32*c* contains a check valve 30*i* for controlling the flow direction of the fluid 12 to the fifth means 21 for inlet and/or discharge of the fluid 12. The first tank 25 comprises an auxiliary tank for temporally storing the fluid 12. A second tank 39 is connected to the first means 15 for inlet and/or discharge of the fluid 12 through pipes 32*f* and 32*e*. Furthermore, the second tank 39 is connected to the sixth means 22 and to the seventh means 23 for inlet and/or discharge of the fluid 12 through pipes 32*f* and 32*d*. Pipe 32*d* contains a check valve 30*f* for controlling the flow direction of the fluid 12 to and from the sixth means 22 for inlet and/or discharge of the fluid 12. Furthermore, the pipe 32*d* contains a check valve 30*e* and a shut off valve 30*d* to control the seventh means 23 for inlet and/or discharge of the fluid 12. The pipe 32*f* contains a check valve 30*l* for controlling the flow direction of the fluid 12 to and from the second tank 39. The pipe 32*e* contains a check valve 30*k* and a shut off valve 30*j* for controlling the first means 15 for inlet and/or discharge of the fluid 12. The second tank 39 is used as a discharge tank. However, shut off valves 30*d*, 30*h* and 30*j*, are not absolutely necessary for the device to work, since they are backing up for check valves 30*e*, 30*g* and 30*k* respectively. Furthermore, check valve 30*l* is not absolutely necessary for the device to work since it is backing up for check valves 30*e*, 30*f* and 30*k* (each exit pipe 32*d* and 32*e* already comprises individual check valves 30*e*, 30*f* and 30*k* for controlling the flow direction of the fluid 12).

The check valves 30*e*, 30*f*, 30*g*, 30*i*, 30*k* and 30*l* allow only one flow direction of the fluid 12 through the pipes. The fluid 12 can only flow through each check valve 30*e*, 30*f*, 30*g*, 30*i*, 30*k*, 30*l* in the direction towards the arrow head of the check valve symbol in FIGS. 2*a* to 2*f*, as illustrated in the sketch below. This means, that the fluid 12 can for example only flow through the check valve 30*l* towards the second tank 39. The fluid 12 cannot flow from the second tank 39 through the check valve 30*l* towards any means for inlet and/or discharge of the fluid 12 of the inventive device 100.

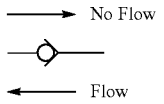

Figure 2A:
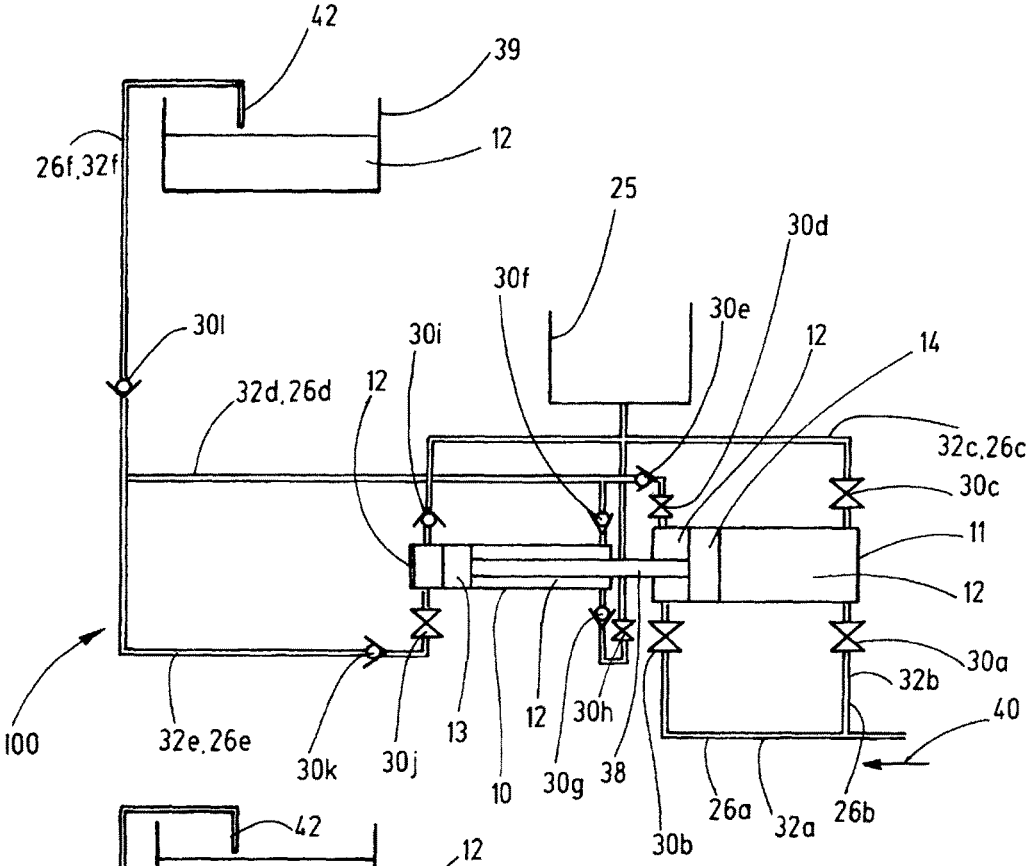
FIG. 2*a-f* show the sequence and explain the procedure of the different steps and how the device is working as a hydrostatic energy generator.

In the initial stage shown in FIG. 2*a*, all shut off valves are closed. Therefore, the fluid 12 will not flow through one of the eight means for inlet and/or discharge of the fluid 12 as long as all shut off valves are closed.

Figure 2B:
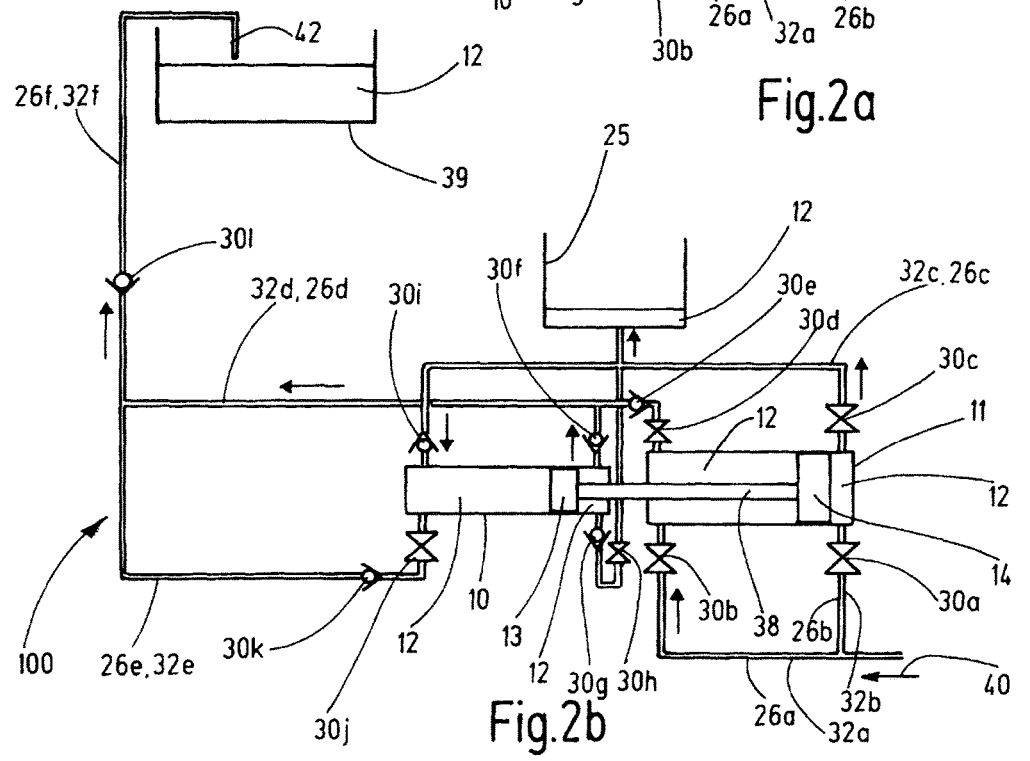

In a first step, shown in FIG. 2*b*, the shut off valve 30*c* and the shut off valve 30*b* are opened. After opening shut off valve 30*b*, fluid 12, assumed to be water in this example, at the static pressure 40 will enter the second chamber 11 through the third means 17 for inlet and/or discharge of the fluid 12. In the example shown in FIG. 2*a* the chambers of the inventive device were initially filled with air before starting of the inventive device or opening any valve. Due to the static pressure 40 applying to the second chamber 11 through the third means 17 for inlet and/or discharge of the fluid 12, the fluid 12 is entering the second chamber 11 and applying pressure to the surface area 36*a* of the front side 36 of the second piston 14. This pressure is forcing the second piston 14 to move from the left to the right position within the second chamber 11. Since the first piston 13 is mechanically connected with the second piston 14, the first piston is moved from the left side to the right side of the first chamber 10 at the same time as the second piston 14 is moved from left to right within the second chamber 11. Therefore, the first volume 19 within the first chamber 10 and the third volume 27 within the second chamber 11 are being increased while the second volume 20 within the first chamber 10 and the fourth volume 28 within the second chamber 11 are being decreased at the same time. The air within the fourth volume 28 of the second chamber 11 flows out of the second chamber 11 through the eight means 24 for inlet and/or discharge of the fluid 12 and flows through pipe 32*c* partially into the auxiliary tank 25 and partially flows into the first volume 19 of the first chamber 10 through the fifth means 21 for inlet and/or discharge of the fluid 12. Since the first chamber 10 is smaller than the second chamber 11, not the entire volume of fluid 12 exiting the second chamber 11, while decreasing the fourth volume, fits into the first volume 19. Therefore, a part of the fluid 12 exiting the second chamber 11 (air at this step) flows into the first tank 25. Furthermore, air from the second volume 20 of the first chamber 10 flows out through the sixth means 22 for inlet and/or discharge of the fluid 12 and flows into the second tank 39 through pipes 32*d* and 32*f*. Once both pistons, the first piston 13 and the second piston 14, have moved from left to right, all shut off valves are closed. FIG. 2*b* shows the inventive device after the first movement of the two pistons 13 and 14 from left to right, before closing valves 30*b* and 30*c*. In this situation, the first volume 19, the second volume 20 and the fourth volume 28 are filled with air. The third volume 27 is now filled with water.

Figure 2C:
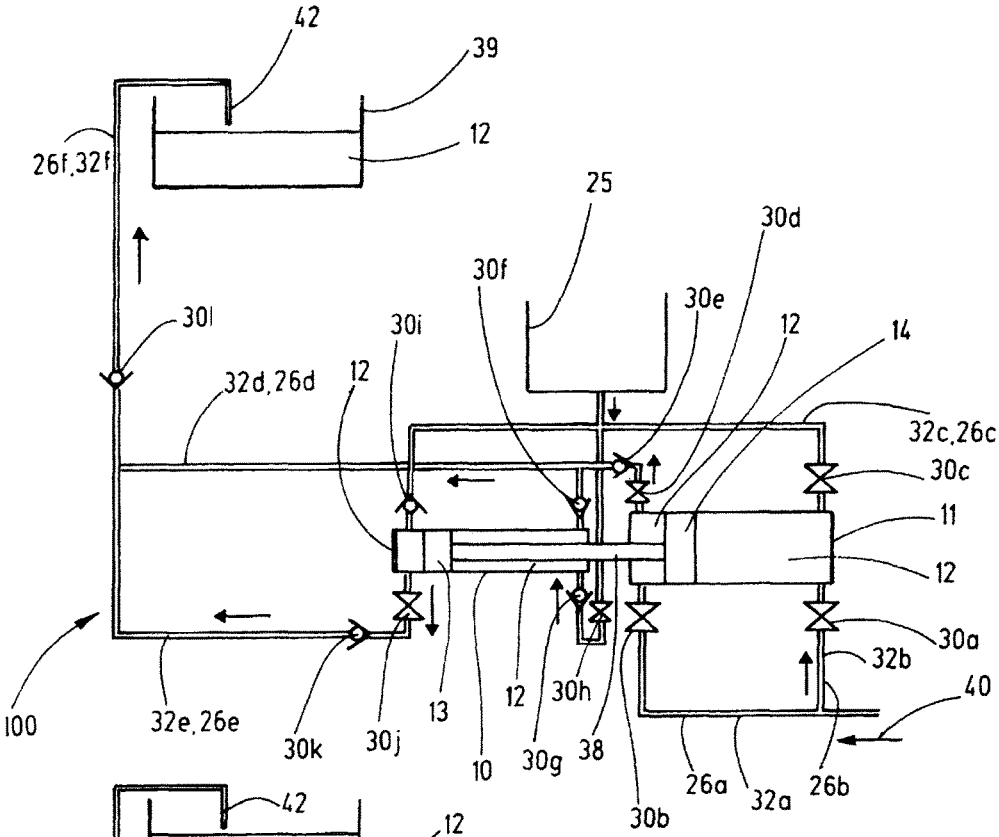

In a next step, shown in FIG. 2*c*, shut off valves 30*j*, 30*d*, 30*h*, and 30*a* are opened. Therefore, the static pressure 40 enters the second chamber 11 through the fourth means 18 for inlet and/or discharge of the fluid 12. The fourth volume 28 of the second chamber 11 is therefore being filled with fluid 12 in this example with water. The pressure applied to the fourth surface area 37*a* of the fourth front side 37 of the second piston 14 is forcing the second piston 14 to move from the right side of the second chamber 11 to the left side of the second chamber 11. Due to the mechanical connection of the two pistons 13 and 14, the first piston 13 is moved from right to left at the same time. The third volume 27 is being decreased while the fluid 12, water, flows out of the third volume 27 of the second chamber 11 through the seventh means 23 for inlet and/or discharge of the fluid 12 into the second tank 39. Since the third surface area 36*a* of the third front side 36 of the second piston 14 is smaller than the fourth surface area 37*a* of the fourth front side 37 of the second piston 14, the pressure within the third volume 27 is higher than the pressure within the fourth volume 28. Also, due to the mechanical connection of the two pistons 13 and 14, the second volume 20 is being increased and first volume 19 is being decreased. Increasing in volume 20 creates a suction effect, while decreasing in volume 19 increases pressure in this volume (air pressure at this step). An increased pressure is also obtained in the first volume 19 of the first chamber 10, since the fourth surface area 37*a* of the fourth front side 37 of the second piston 14 is larger than the first surface area 34*a* of the first front side 34 of the first piston 13. The fluid 12 temporally stored within the first tank 25 (air at this step) enters the first chamber 10 through the second means 16 for inlet and/or discharge of the fluid 12 as the second volume 20 increases. The air within the first volume of the first chamber 10 is forced through the first means for inlet and/or discharge of the fluid 12 through valves 30*j* and 30*k*. Once the first piston 13 and the second piston 14 have been moved back from right to left all shut off valves are closed. FIG. 2*c* shows the step after movement of the two pistons 13, 14 back from the right side to the left side of each chamber 10, 11 before closing the valves 30*a*, 30*d*, 30*h*, 30*j*.

Figure 2D:
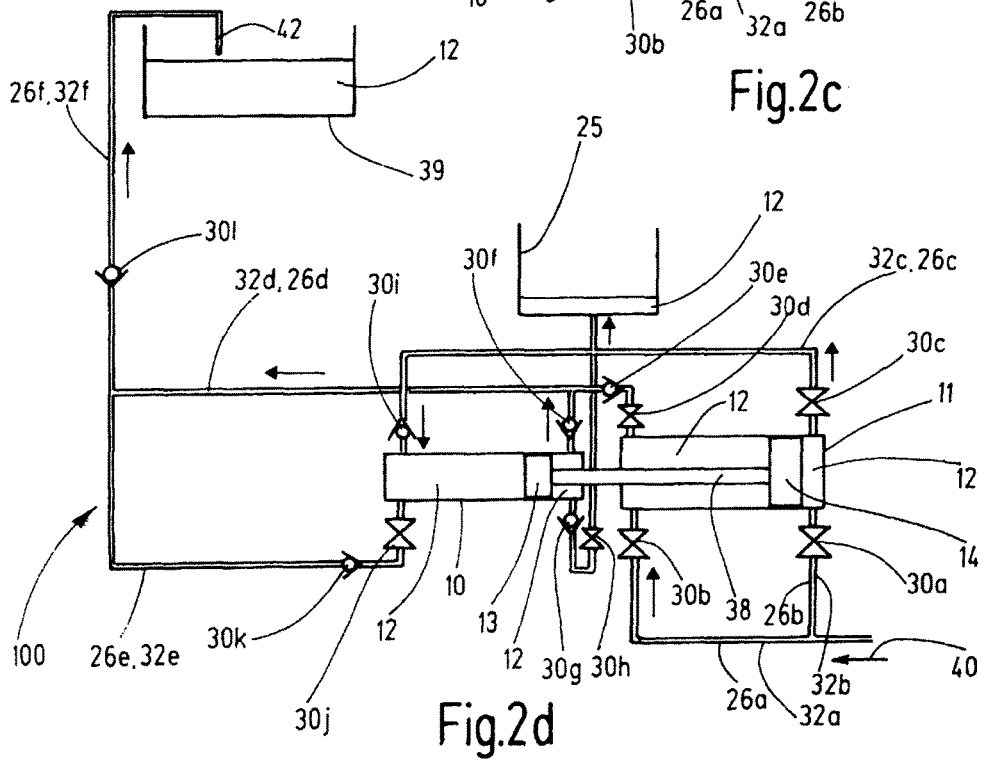

FIG. 2*d* shows the next step for moving back both pistons 13, 14 from the left side of each chamber 10, 11 to the right of each chamber 10, 11. For moving back the first piston 13 and the second piston 14, the shut off valves 30*b* and 30*c* are opened. Therefore, water at the static pressure 40 enters the third volume 27 of the second chamber 11 through the third means 17 for inlet and/or discharge of the fluid 12 and through valve 30*b*. Therefore, the third volume 27 within the second chamber 11 is being increased and the fourth volume 28 within second chamber 11 is being decreased while the second piston 14 is moved back from left to right within the second chamber 11. Due to the mechanical connection of the first piston 13 with the second piston 14, the first piston 13 is also moved from the left side of the first chamber 10 to the right side of the first chamber 10. Therefore, also the first volume 19 of the first chamber 10 is being increased, thus creating a suction effect in volume 19, while the second volume 20 of the first chamber 10 is being decreased, thus increasing pressure in this volume 20. An increased pressure is obtained also in this volume 20 since the third surface area 36*a* of the third front side 36 of the second piston 14 is larger than the second surface area 35*a* of the second front side 35 of the first piston 13. The water within the fourth volume 28 of the second chamber 11 exits the second chamber 11 through the eight means 24 for inlet and/or discharge of the fluid 12 and partially enters the first chamber 10 through the check valve 30*i* and through the fifth means 21 for inlet and/or discharge of the fluid 12 while increasing the first volume 19. The remaining part of the fluid 12 enters the first tank 25. Once both pistons, the first piston 13 and the second piston 14, have moved back from the left to the right side of each chamber 10, 11, all valves are closed.

Figure 2E:
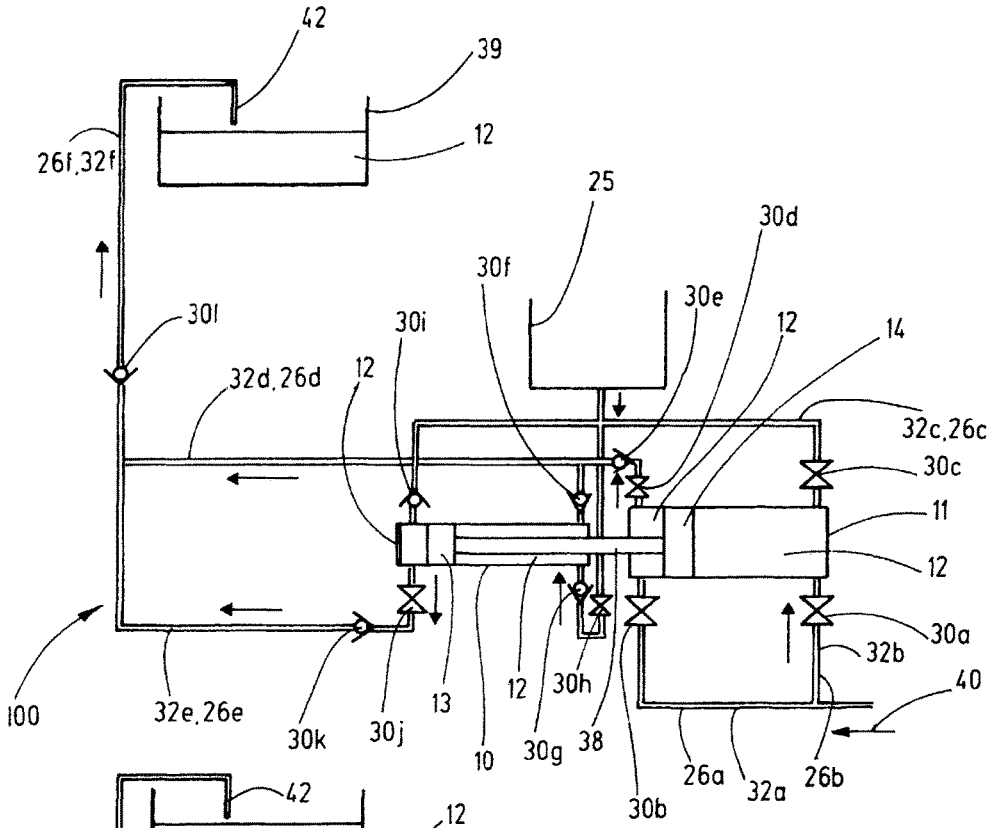

FIG. 2*e* shows the next step for moving back the pistons 13, 14 from the right side to the left side. For this step, shut off valves 30*j*, 30*d*, 30*h*, and 30*a* are opened. Water at the static pressure 40 enters the second chamber 11 through valve 30*a* and through the fourth means 18 for inlet and/or discharge of the fluid 12 while increasing the fourth volume 28. This causes the second piston 14 to move from the right side of the second chamber 11 to the left side of the second chamber 11. Due to the mechanical connection of the two pistons 13 and 14, the first piston 13 is moved from the right side of the first chamber 10 to the left side of the first chamber 10 at the same time. Due to differences between the different involved surface areas, i.e., fourth surface area 37*a* larger than third surface area 36*a*, and fourth surface area 37*a* larger than first surface area 34*a*, the pressure within the first volume 19 of the first chamber 10, and within the third volume of the second chamber 11, are substantially increased. The fluid 12 exits the third volume 27 of the second chamber 11 through the seventh means 23 for inlet and/or discharge of the fluid 12 and flows through the valves 30*d* and 30*e* and enters the second tank 39. Furthermore, the fluid 12 exits the first volume 19 of the first chamber 10 through the first means 15 for inlet and/or discharge of the fluid 12 and flows through the valves 30*j* and 30*k*, and 30*l* and enters the second tank 39. Additionally, the fluid 12 temporally stored within the first tank 25 is sucked by the second volume 20 and enters the first chamber 10 through the valves 30*h*, 30*g* and the second means 16 for inlet and/or discharge of the fluid 12. Once the two pistons 13 and 14 have moved back from the right side to the left side within each chamber 10 and 11, all shut off valves are closed.

Figure 2F:
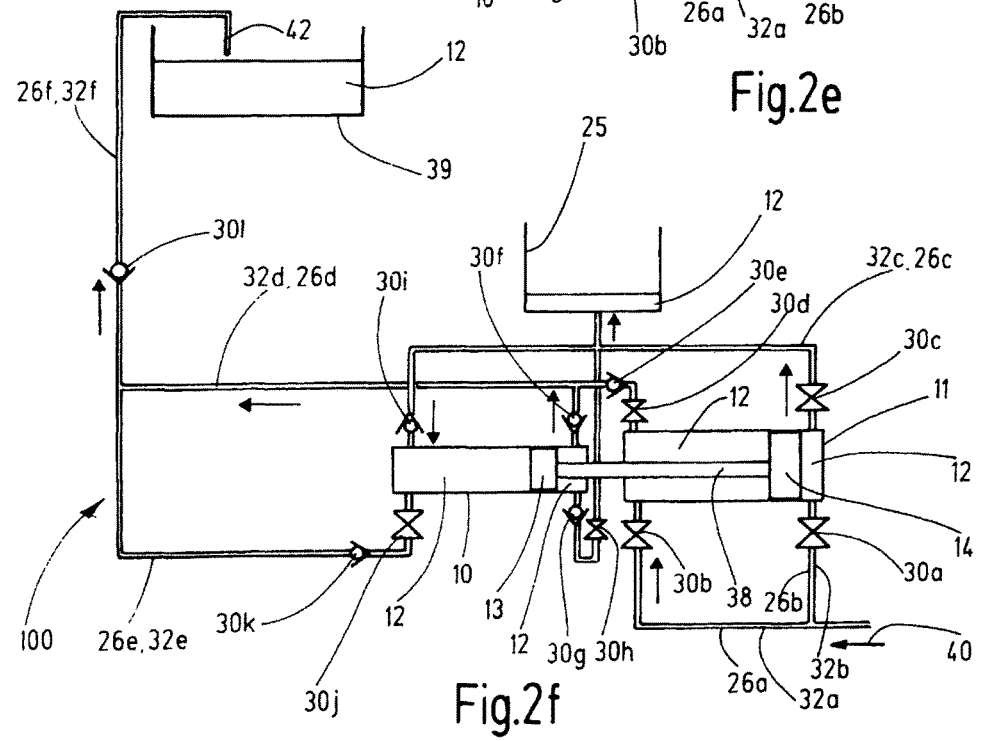

FIG. 2*f* shows the next step for moving the pistons 13, 14 back from left to right. Therefore, the shut off valves 30*c* and 30*b* are opened. Water at the static pressure 40 enters the second chamber 11 through the valve 30*b* and the third means 17 for inlet and/or discharge of the fluid 12. Therefore, the third volume 27 within the second chamber 11 is being increased while the fourth volume 28 within the second chamber 11 is being decreased. The second piston 14 and the first piston 13 are moved back from the left side to the right within each chamber 10 and 11. The fluid 12 exits the second chamber 11 through the eight means 24 for inlet and/or discharge of the fluid 12 and partially enters the first chamber 10 through the fifth means 21 for inlet and/or discharge of the fluid 12, sucked by the first volume 19, while the remaining fluid 12 enters the auxiliary tank 25. Since the first volume 19 increases while the second volume 20 decreases, and since the third surface area 36*a* is larger than the second surface area 35*a*, pressure increases in second volume 20, and the fluid 12 exits the first chamber 10 through the sixth means 22 for inlet and/or discharge of the fluid 12 and enters the second tank 39. Once both pistons, the first piston 13 and the second piston 14 have moved back from the left side to the right side within each chamber 10, 11, all valves are closed.

Sequence will continue in a cycling process while the system of control opens and closes valves as indicated in this example for FIGS. 2*a* to 2*f*.

Figure 3A:
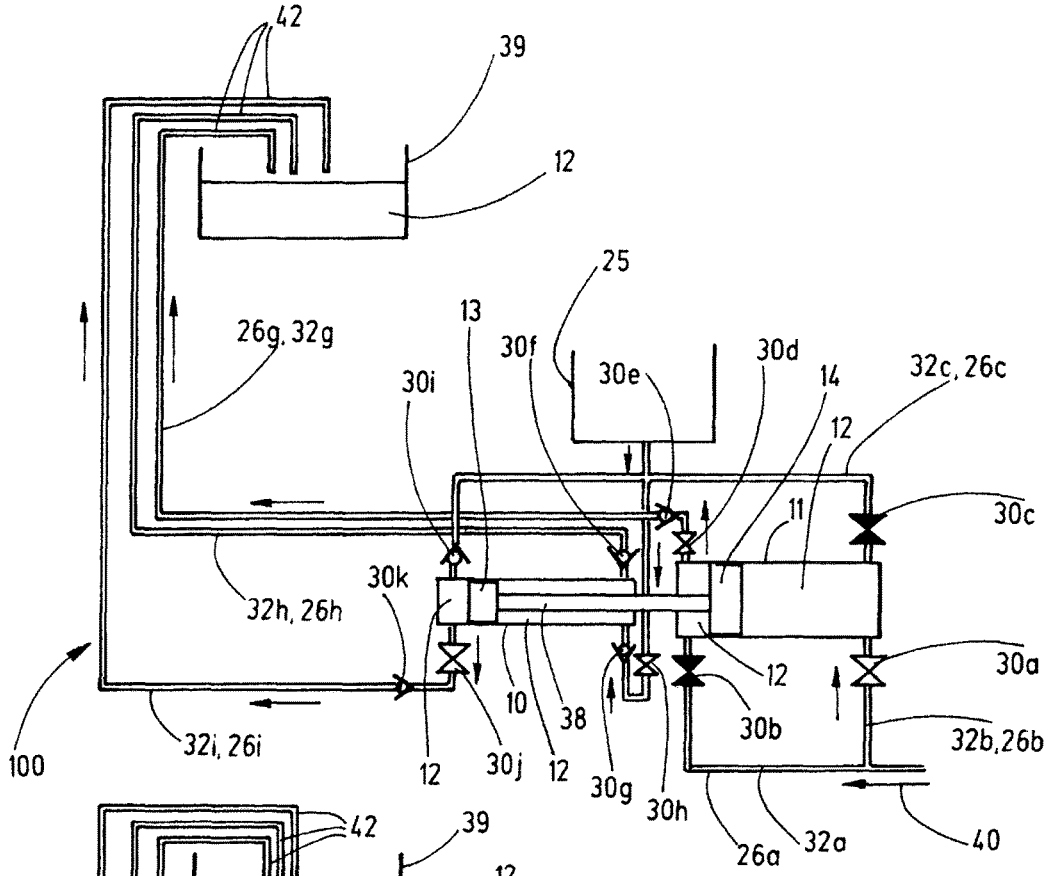
FIG. 3*a-b* show an embodiment of the device for exploiting hydrostatic energy with individual exit pipes.
Figure 3B:
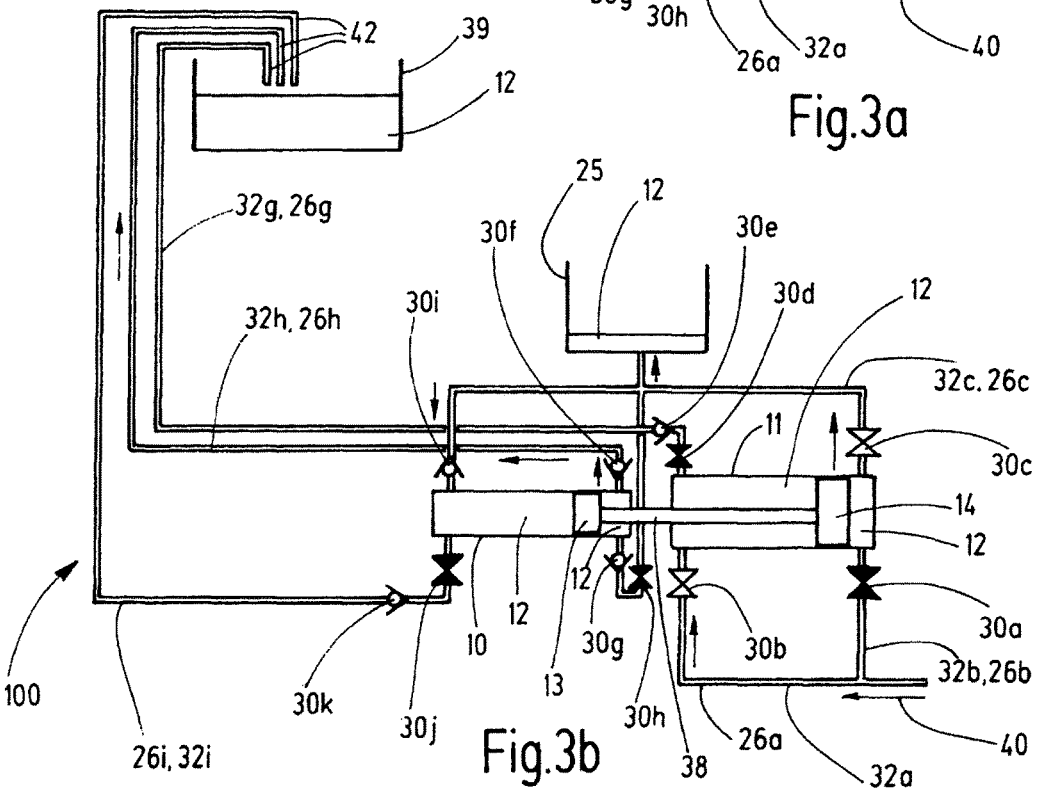

FIGS. 3*a* and 3*b* show an embodiment of the device for exploiting hydrostatic energy with individual exit pipes 32*g*, 32*h*, 32*i*. Compared to the embodiment shown in FIGS. 2*a* to 2*f*, the embodiment shown in FIGS. 3*a* and 3*b* consists of individual exit pipes 32*g*, 32*h*, and 32*i*. The three exit pipes 32*g*, 32*h* and 32*i* are replacing the pipes 32*d*, 32*e*, and 32*f*. The exit pipe 32*g* is connecting the seventh means 23 for inlet and/or discharge of the fluid 12 with the second tank 39. The pipe 32*h* is connecting the sixth means 22 for inlet and/or discharge of the fluid 12 with the second tank 39. The pipe 32*i* is connecting the first means 15 for inlet and/or discharge of the fluid 12 with the second tank 39. The check valve 30*l* is not necessary for the preferred embodiment based on FIGS. 3*a* and 3*b* since each exit pipe 32*g*, 32*h*, 32*i* is separately connected to the second tank 39 and already comprises individual check valves 30*e*, 30*f*, 30*k* for controlling the flow direction of the fluid 12.

Figure 4:
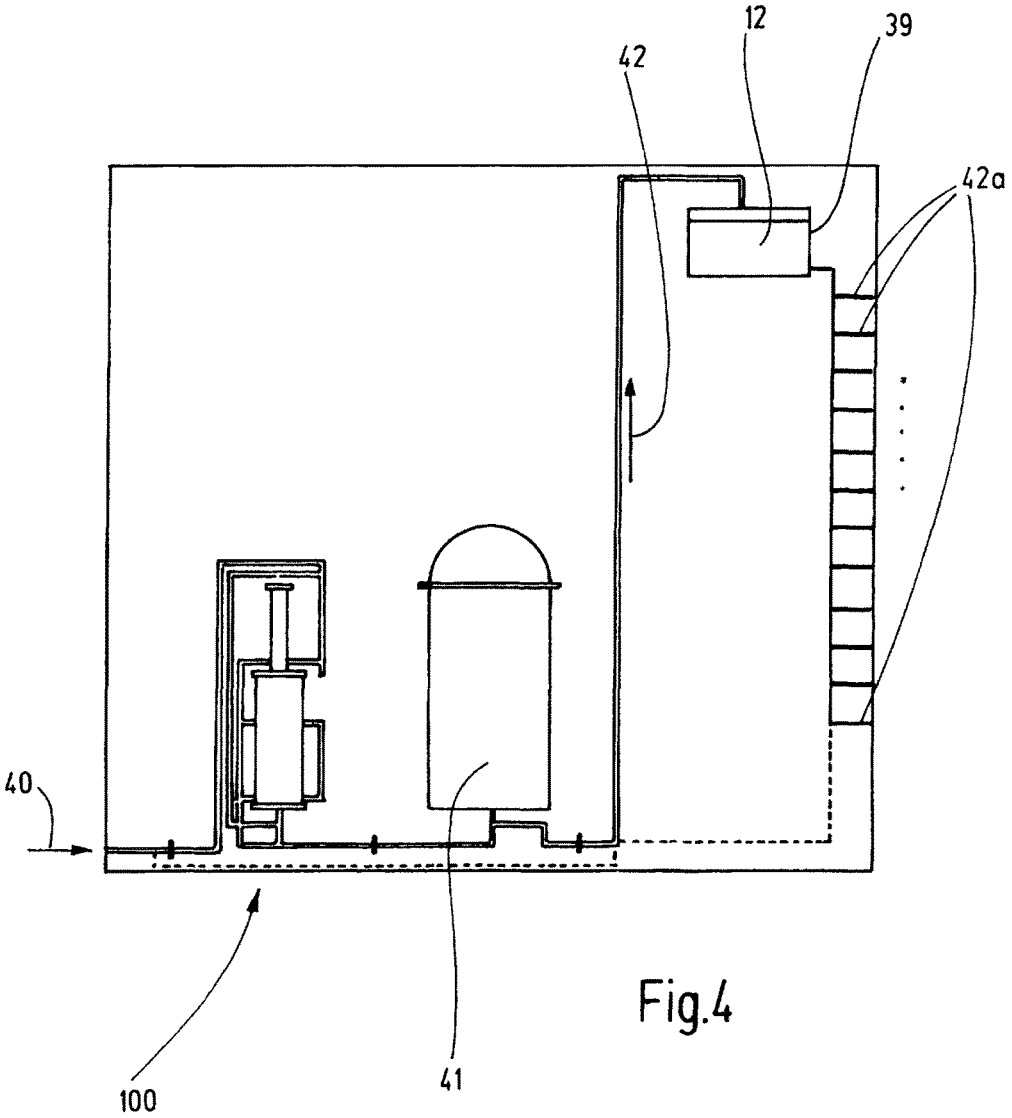
FIG. 4 shows an application wherein the device for exploiting hydrostatic energy can be used for delivering hydraulic energy.

FIG. 4 shows an application wherein the device 100 for exploiting hydrostatic energy can be used for delivering hydraulic energy, for instance an increased output pressure 42 compared to the incoming hydrostatic pressure 40. Such an application can be for example used to deliver water to houses or to high rise buildings. Furthermore such an application can be used as the prime or sole of water supply system 42*a*. In this case, the increased discharge pressure is discharged into a pressure tank, e.g. a pressurized hydro-pneumatic tank to provide a specific flow and pressure pattern for water supply.

Figure 5:
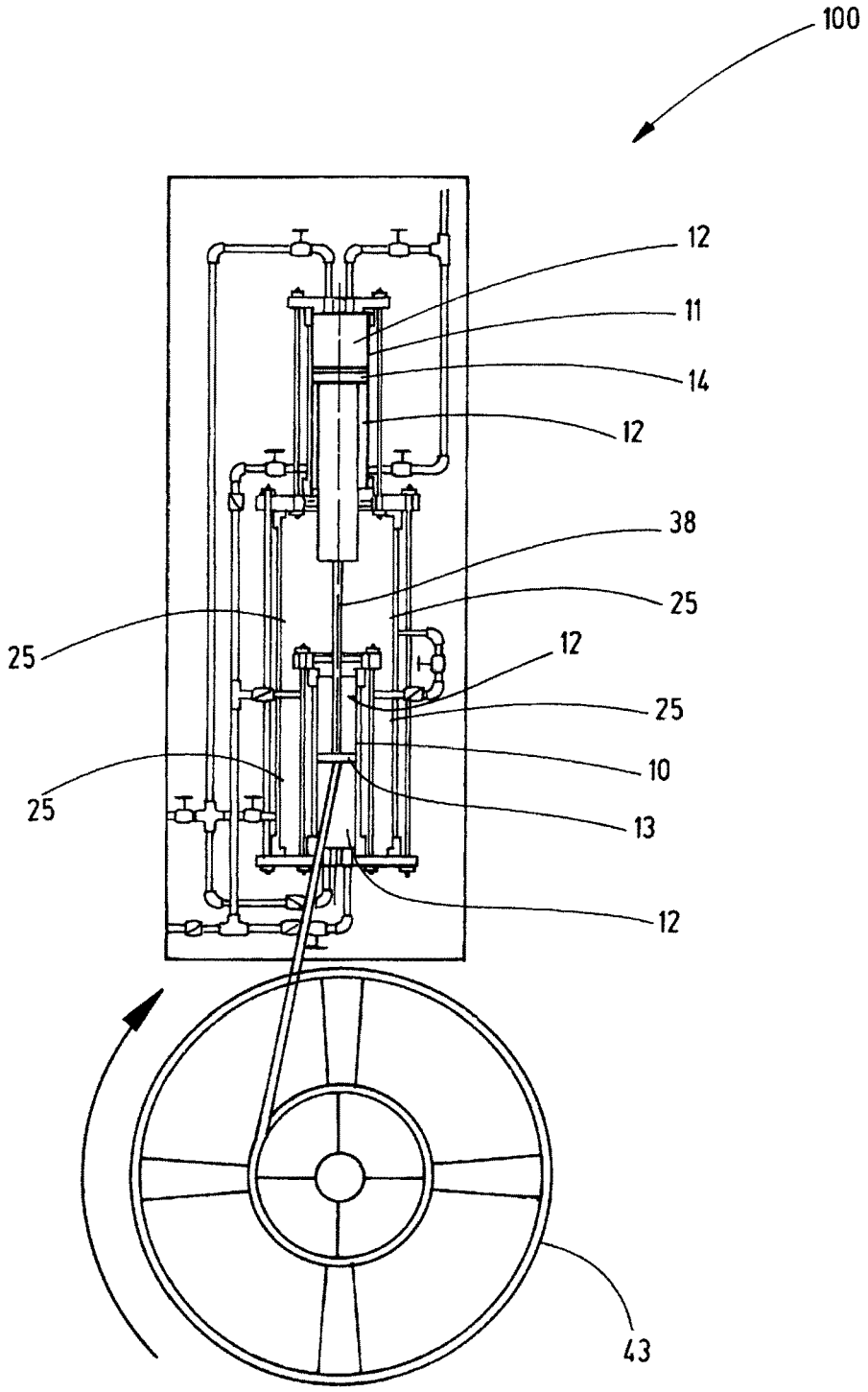
FIG. 5 shows a principal application for generating mechanical energy.

FIG. 5 shows a principal application for generating mechanical energy by connecting a wheel for example a fly-wheel 43, to one of the pistons 13, 14 arranged within a chamber 10, 11 of the device 100 for exploiting hydrostatic energy. Instead of connecting the fly-wheel 43 to one of the two pistons 13 or 14, the fly-wheel 43 could also be connected to a rod 38 or any other appropriate connection means which is used to connect the first piston 13 with the second piston 14. In this case, the incoming hydrostatic pressure, once in the interior of the device, and due to differences in surface areas of each piston, moves the interior pistons up and down or back-and-forth (in a reciprocating movement) which is converted into rotational movement. Such an embodiment can be used to store rotational energy and stabilize rotational speed. Furthermore, such an application can be used to generate mechanical energy for moving any machine or vehicle or any other application. Such an embodiment can be used at the primary or sole mover or drive system for vehicles, e.g. cars, buses, trains, ships, etc.

Figure 6:
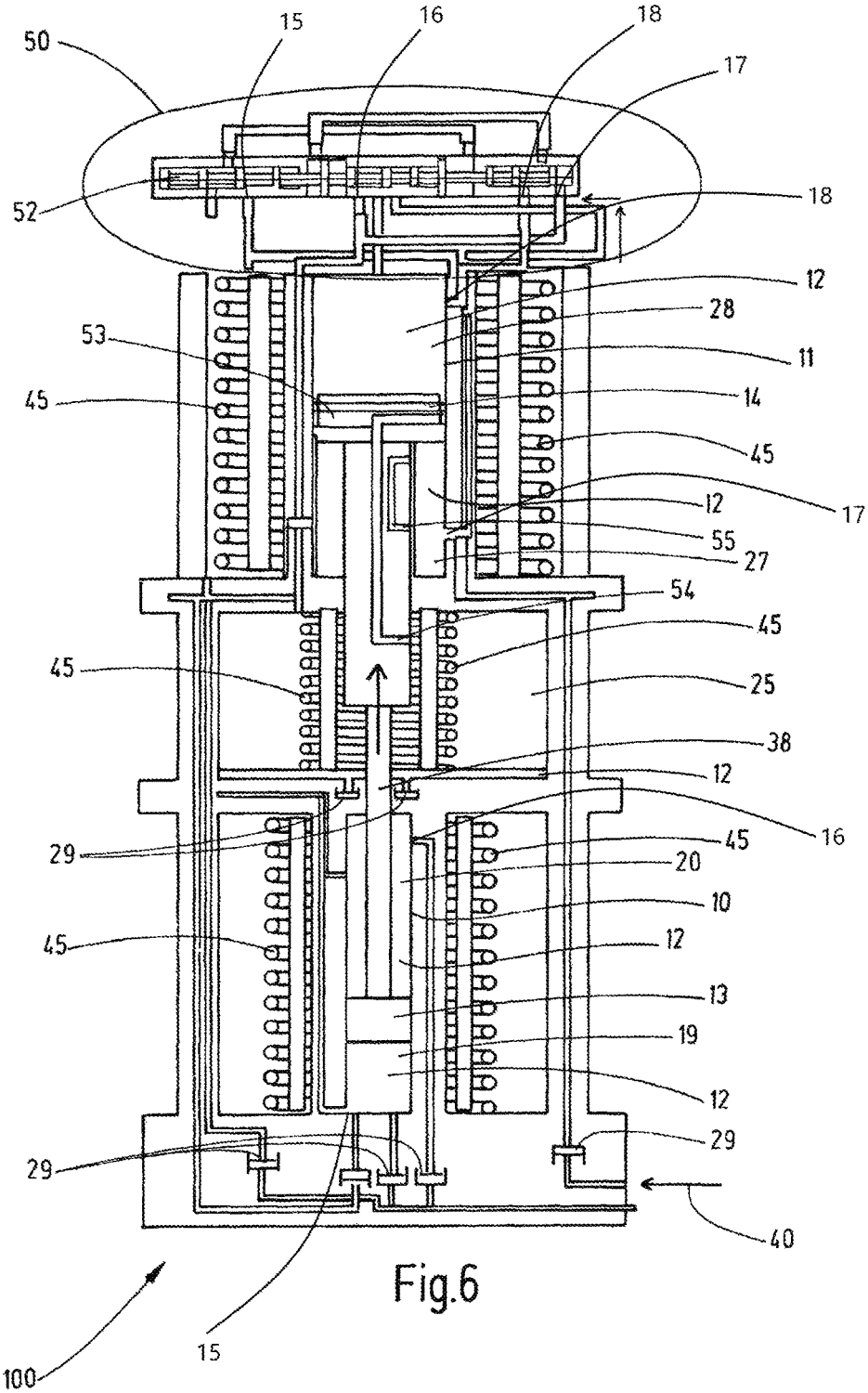
FIG. 6 shows an application for generation of electrical energy.

FIG. 6 shows an application for generation of electrical energy. In such an application, the movement of the pistons 13, 14 within the chambers 10, 11 of the device 100 for exploiting hydrostatic energy is used to produce a necessary changing magnetic field to produce electric energy. Instead of applying high forces against the fluid 12 to increase the discharging pressure, they can be applied against a "changing with the time magnetic field" to generate electric energy directly. Such a configuration or embodiment is based on the Faradays law of electromagnetic induction, which applies to the production of electric current across a conductor moving through a magnetic field. Based on the Faradays law, the electromotive force (EMF) around an electric closed path is proportional to the rate of change of the magnetic flux to any surface bounded by the path. In other words, an electric current will be induced in any closed circuit when the magnetic flux through a surface bounded by the conductor changes. This applies whether the field itself changes in strength or the conductor is moved through it. The incoming hydrostatic pressure 40, once in the interior of the inventive device 100, due to differences in surface areas of each piston moves an interior piston 13, 14 up and down or back-and-forth in a reciprocating movement. This movement is then used to produce the necessary changing magnetic field to produce electric energy. For this purpose, the device 100 comprises electric wire coils 45 arranged around the first chamber 10 and around the second chamber 11. Additionally, the embodiment shown in FIG. 6 may comprise, or may not, an automatic directional valve 50 for controlling the means for inlet and/or discharge of the fluid 12. The automatic directional valve 50 replaces most of the check valves and shut off valves in the embodiments based on FIGS. 2 and 3.

FIGS. 7*a* to 7*e* shows different examples of how the inventive device 100 for exploiting hydrostatic energy can be connected to other means or additional inventive devices 100.

Figure 7A:
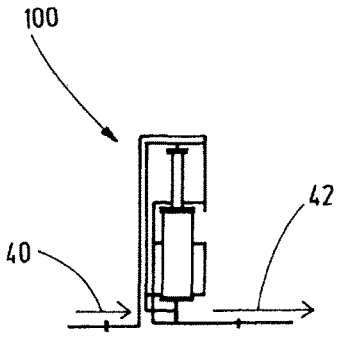
FIG. 7*a* shows the principal inventive device for exploiting hydrostatic energy with an incoming source and an outlet, such as a higher pressure energy level.

FIG. 7*a* shows the principal inventive device 100 for exploiting hydrostatic energy with an incoming source 40 and an outlet 42, such as a higher pressure energy level.

Figure 7B:
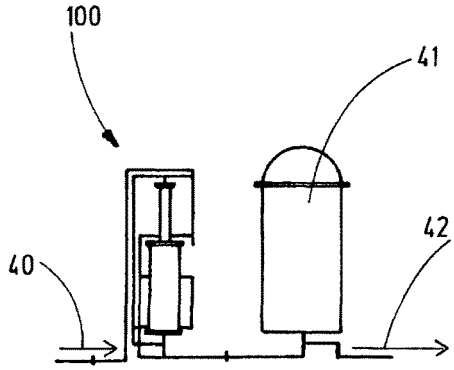
FIG. 7*b* shows the principal inventive device connected to a pressure tank, e.g. a hydro-pneumatic tank.

FIG. 7*b* shows the principal inventive device 100 connected to a pressure tank, e.g. a hydro-pneumatic tank 41.

Figure 7C:
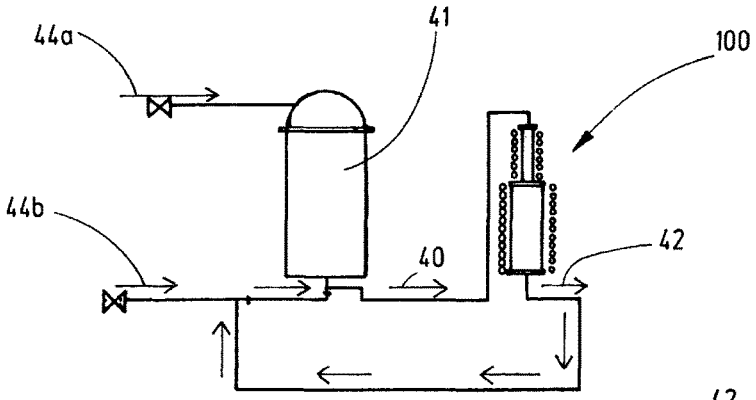
FIG. 7*c* shows the device for exploiting hydrostatic energy connected to a hydrostatic pressure source such as a pressurized hydro-pneumatic tank.

FIG. 7*c* shows the device 100 for exploiting hydrostatic energy connected to a hydrostatic pressure source such as a pressurized hydro-pneumatic tank 41. In this case, device 100 and hydro-pneumatic tank 41 has been arranged in a close circuit. The hydrostatic pressure 40 has in this case been previously charged in the hydro-pneumatic tank by using for example pressurized air. Since discharge pressure 42 is significantly higher than the hydrostatic pressure 40 in the hydro-pneumatic tank, the discharged flow can be easily injected back into the hydro-pneumatic tank. This means, that only a very small part of the total discharged energy is taken to inject this flow back. The remaining energy (which is the higher part) is then available to be utilized to carry out any specific work, for example, as electric energy generator. Connection means 44*a* is for eventual air compensation in the hydro-pneumatic tank. Connection means 44*b* is for eventual water compensation in the hydraulic close circuit.

Figure 7D:
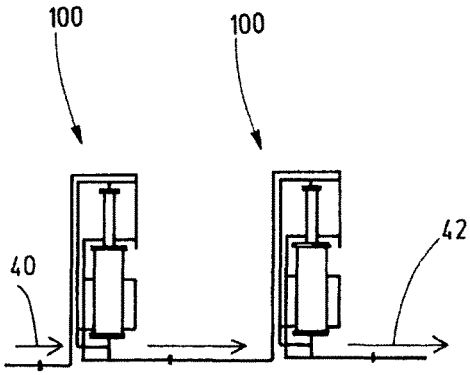
FIG. 7*d* shows two devices for exploiting hydrostatic energy connected in series.

FIG. 7*d* shows two devices 100 for exploiting hydrostatic energy connected in series. It is further possible to connect more than two devices 100 for exploiting hydrostatic energy in series together.

Figure 7E:
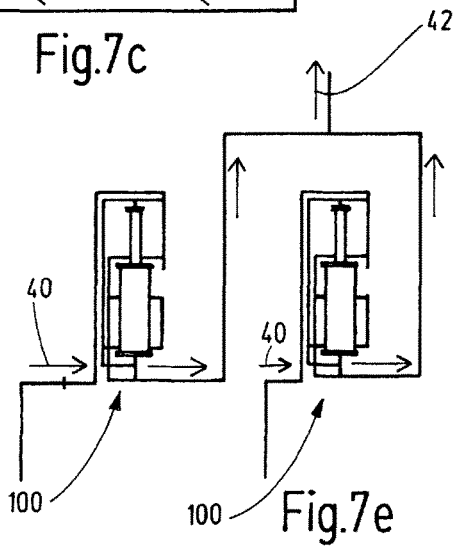
FIG. 7*e* shows two devices for exploiting hydrostatic energy connected in parallel to each other.

FIG. 7*e* shows two devices 100 for exploiting hydrostatic energy connected in parallel to each other. It is further possible to connect more than two devices 100 for exploiting hydrostatic energy in parallel together.

Furthermore it is possible that multiple devices 100 for exploiting hydrostatic energy can be connected in series and parallel together.

Figure 8:
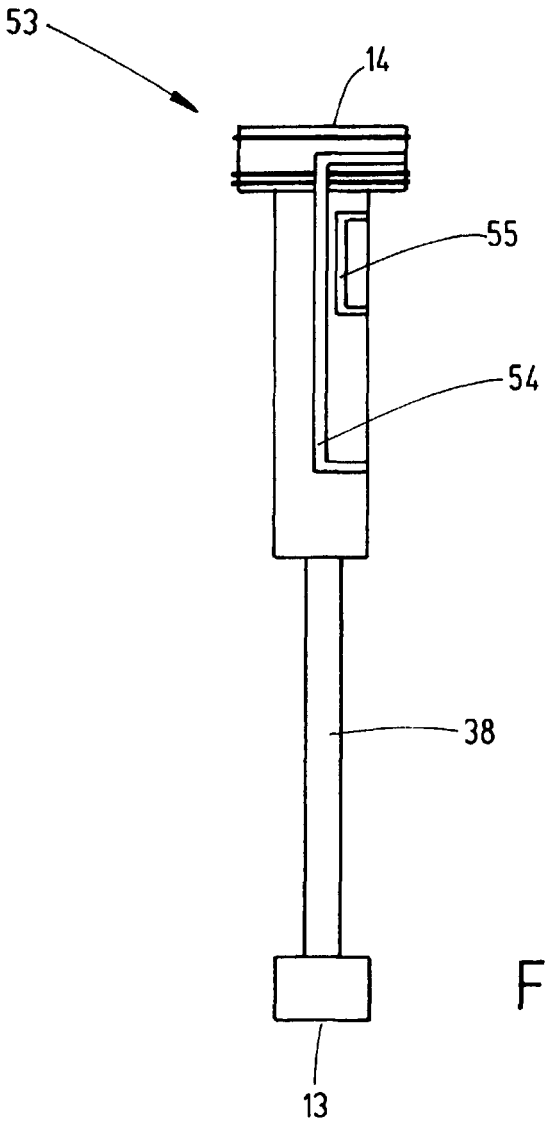
FIG. 8 shows the hydrostatic energy generator internal piston, included in the device for exploiting hydrostatic energy.

FIG. 8 shows the hydrostatic energy generator internal piston 53, included in the device 100 for exploiting hydrostatic energy, which consists of the first piston 13 and the second piston 14 connected together by the rod 38. For detecting when the hydrostatic energy generator internal piston 53 reaches the upper end or the lower end during the movement within the first chamber 10 and the second chamber 11, the position of the valve internal piston 52 (see FIGS. 9*a* and 9*b*) must be synchronized with the hydrostatic energy generator internal piston 53. Therefore, the hydrostatic energy generator internal piston 53 includes two internal holes, a first internal hole 54 and a second internal hole 55. The first internal hole 54 activates the automatic hydraulic directional valve 50 when the hydrostatic energy generator internal piston 53 reaches the upper end. The second internal hole 55 activates the automatic hydraulic directional valve 50 when the hydrostatic energy generator internal piston 53 reaches the lower end. The term "Activates the automatic hydraulic directional valve 50" means that the incoming static source 40 (e.g. hydrostatic pressure) is transferred through these internal holes to the automatic hydraulic directional valve 50 to push the valve internal piston 52. This means that the valve internal piston 52 is pushed in a reciprocating movement from the right end to the left end and vice versa.

The rod 38 shown in FIG. 8 further comprises two sectional areas with different diameters. The diameter of the rod 38 at the sectional area which is connected to the first piston 13 comprises a smaller diameter compared to the diameter of the rod 38 at the sectional area connected to the second piston 14. Due to the rod comprising two sectional areas with different diameters, a special ratio between the four surface areas of the pistons is adjusted. Furthermore, in order to provide automatic work for the device, two internal holes, 54 and 55 have been arranged inside of the rod 38 at the sectional area with larger diameter. These internal holes are sensors to detect each stroke end, and also to provide the required path of flow to route the incoming and exiting pressures to the proper chambers as already explained. Arranging the internal holes 54, 55 within the rod 38 at the sectional area with the larger diameter provides advantages regarding the routing of these internal holes 54, 55.

Figure 9A:
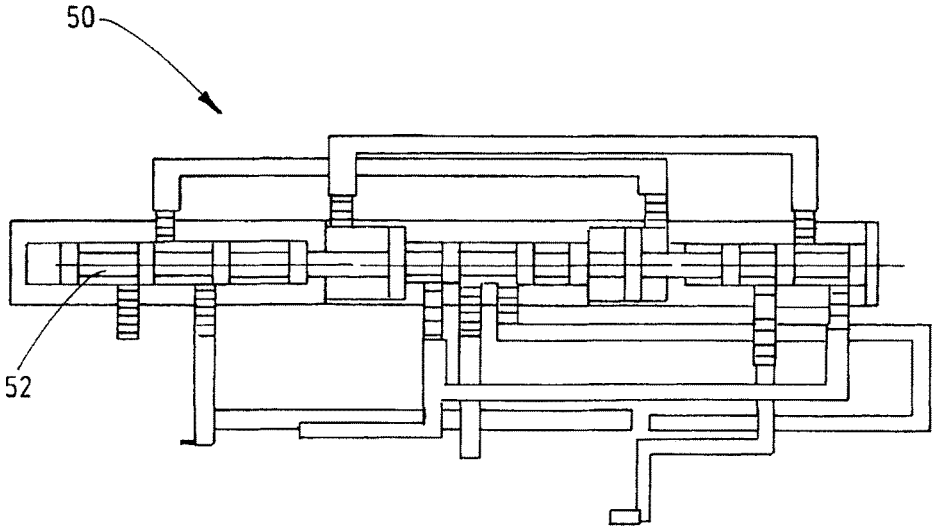
FIG. 9*a-b* show the movement of the position of the valve internal piston included in the automatic directional valve.
Figure 9B:
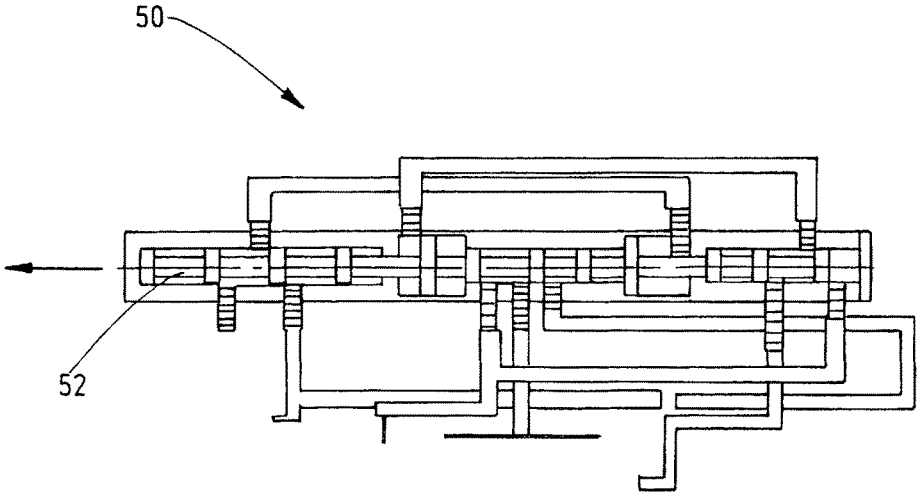

FIGS. 9*a* and 9*b* show the movement of the position of the valve internal piston 52 included in the automatic directional valve 50 (FIG. 9*a* shows the valve internal piston 52 at the right end; FIG. 9*b* shows piston 52 at the left end). The incoming static pressure source 40 (e.g. hydrostatic incoming pressure) enters the second chamber 11 and fills the third volume 27 and pushes up the hydrostatic energy generator internal piston 53. While the hydrostatic energy generator internal piston 53 is moving up, the valve internal piston 52 is at the left end. While the hydrostatic energy generator internal piston 53 is at the upper end of the second chamber 11, the valve internal piston 52 is being pushed from the left end to the right end. Once the valve internal piston 52 is at the right end, flow paths change so that incoming static pressure source 40 (e.g. hydrostatic incoming pressure) moves into the second chamber 11 of the device 100 for exploiting hydrostatic energy but now filling the fourth volume 28, pushing down the hydrostatic energy generator internal piston 53. While the hydrostatic energy generator internal piston 53 is moving down, the valve internal piston 52 is at the right end. While the hydrostatic energy generator internal piston 53 is at the lower end of the second chamber 11, the valve internal piston 52 is being pushed form the right end to the left end. Once the valve internal piston 52 is at the left end, flow paths change so that the incoming static pressure source 40 (e.g. hydrostatic incoming pressure) moves into the second chamber 11 of the device 100 for exploiting hydrostatic energy but not filling the third volume 27 again, pushing again up the hydrostatic energy generator internal piston 53. In this way a cycle is complete and is repeated.

The automatic directional valve 50 including the valve internal piston 52 as shown in FIGS. 9*a* and 9*b* is connected with the means 15, 16, 17, 18, 21, 22, 23, 24 for inlet and/or discharge of the fluid 12 of the device 100 for exploiting hydrostatic energy shown in FIG. 1. Therefore, the automatic directional valve 50 is used to control the means 15, 16, 17, 18, 21, 22, 23, 24 for inlet and/or discharge of the fluid 12 in an automatic manner and therefore can solve the function of multiple valves. Alternatively, multiple directional valves can be used instead of one single automatic directional valve 50 to control the means 15, 16, 17, 18, 21, 22, 23, 24 for inlet and/or discharge of the fluid 12. It is therefore possible to connect one valve to each of the means 15, 16, 17, 18, 21, 22, 23, 24 for inlet and/or discharge of the fluid 12 or to connect one valve to multiple of the means 15, 16, 17, 18, 21, 22, 23, 24 for inlet and/or discharge of the fluid 12.

REFERENCE CHARACTER LIST

100 Device for exploiting hydrostatic energy
10 First chamber
11 Second chamber
12 Fluid
13 First piston
14 Second piston
15 First means for inlet and/or discharge of the fluid
16 Second means for inlet and/or discharge of the fluid
17 Third means for inlet and/or discharge of the fluid
18 Fourth means for inlet and/or discharge of the fluid
19 First volume
20 Second volume
21 Fifth means for inlet and/or discharge of the fluid
22 Sixth means for inlet and/or discharge of the fluid
23 Seventh means for inlet and/or discharge of the fluid
24 Eight means for inlet and/or discharge of the fluid
25 First tank
26*a*-26*i* Connection means
27 Third volume
28 Fourth volume
29 Specially designed check valves (30*e*, 30*f*, 30*g*, 30*i*, 30*k* and 30*l*)
30*a*-30*l* Control means, valves
32*a*-32*i* Pipes
33*a* First chamber wall, first front side of the first chamber
33*b* Second chamber wall, second front side of the first chamber
33*c* Third chamber wall, third front side of the first chamber
33*d* Fourth chamber wall, fourth front side of the first chamber
33*e* Fifth chamber wall, fifth front side of the second chamber
33*f* Sixth chamber wall, sixth front side of the second chamber
33*g* Seventh chamber wall, seventh front side of the second chamber
33*h* Eighth chamber wall, eighth front side of the second chamber
34 First front side of first piston
34*a* Surface area of first front side of the first piston
35 Second front side of the first piston
35*a* Surface area of the second front side of the first piston
36 Third front side of the second piston
36*a* Surface area of the third front side of the second piston
37 Fourth front side of the second piston
37*a* Surface area of the fourth front side of the second piston
38 Connection means for connecting the first piston with the second piston, rod
39 Second tank
40 Incoming static pressure source
41 Hydro-pneumatic tank
42 Increased output pressure
42*a* Water supply pipes
43 Fly-wheel
44*a* Connection means for eventual air leak compensation in hydro-pneumatic tank
44*b* Connection means for eventual water leak compensation in hydraulic close circuit
45 Electric wire coil
50 Automatic directional valve
51 Third piston
52 Valve internal piston
53 Hydrostatic energy generator internal piston
54 First internal hole
55 Second internal hole

The invention claimed is:

1. A hydrostatic energy generator (100), comprising:

at least a first chamber (10) and a second chamber (11), wherein the first chamber (10) and the second chamber (11) are at least partially filled with a fluid (12);

a hydrostatic energy generator internal piston (53), which comprises a first piston (13) and a second piston (14), wherein the first piston (13) is movably arranged within the first chamber (10) and the second piston (14) is movably arranged within the second chamber (11), wherein the first piston (13) is mechanically or hydraulically connected to the second piston (14);

wherein the first chamber (10) comprises at least a first passageway (15) for inlet and/or discharge of the fluid (12) and a second passageway (16) for inlet and/or discharge of the fluid (12);

wherein the second chamber (11) comprises at least a third passageway (17) for inlet and/or discharge of the fluid (12) and a fourth passageway (18) for inlet and/or discharge of the fluid (12); and an automatic hydraulic directional valve (50), wherein the automatic, hydraulic directional valve (50) comprises at least a third piston (52), wherein the automatic hydraulic directional valve (50) is connected to the first passageway (15) for inlet and/or discharge of the fluid (12) and to the second passageway (16) for inlet and/or discharge of the fluid (12) and to the third passageway (17) for inlet and/or discharge of the fluid (12) and to the fourth passageway (18) for inlet and/or discharge of the fluid (12);

wherein the automatic hydraulic directional valve (50) controls the flow of the fluid (12) to and from a first volume (19), a second volume (20), a third volume (27), and a fourth volume (28), wherein the hydrostatic energy generator internal piston (53) includes a first internal hole (54) and a second internal hole (55) for synchronizing a position of the third piston (51) with a position of the hydrostatic energy generator internal piston (53), and wherein the first internal hole (54) allows the fluid in the fourth volume (28) to be transferred to the automatic hydraulic directional valve (50) to activate the internal piston (52) of the automatic hydraulic directional valve (50) when the hydrostatic energy generator internal piston (53) reaches an upper end of the second chamber (11), and the second internal hole (55) allows the fluid in the third volume (27) to be transferred to the automatic hydraulic directional valve (50) to activate the internal piston (52) of the automatic hydraulic directional valve (50) when the hydrostatic energy generator internal piston (53) reaches a lower end of the second chamber (11).

2. A hydrostatic energy generator (100) according to claim 1, wherein the first piston (13) splits up the interior of the first chamber (10) into the first volume (19) and the second volume (20) and wherein the first passageway (15) for inlet and/or discharge of the fluid (12) is allocated to the first volume (19) and wherein the second passageway (16) for inlet and/or discharge of the fluid (12) is allocated to the second volume (20), and wherein the second piston (14) splits up the interior of the second chamber (11) into the third volume (27) and the fourth volume (28) and wherein the third passageway (17) for inlet and/or discharge of the fluid (12) is allocated to the third volume (27) and wherein the fourth passageway (18) for inlet and/or discharge of the fluid (12) is allocated to the fourth volume (28).

3. A hydrostatic energy generator (100) according to claim 1, wherein the first chamber (10) comprises a fifth passageway (21) for inlet and/or discharge of the fluid (12) and a sixth passageway (22) for inlet and/or discharge of the fluid (12) and wherein the second chamber (11) comprises a seventh passageway (23) for inlet and/or discharge of the fluid (12) and an eighth passageway (24) for inlet and/or discharge of the fluid (12).

4. A hydrostatic energy generator (100) according to claim 3, further comprising a first tank (25) connected to the first passageway (15) for inlet and/or discharge of the fluid (12) and/or to the second passageway (16) for inlet and/or discharge of the fluid (12) and/or to the third passageway (17) for inlet and/or discharge of the fluid (12) and/or to the fourth passageway (18) for inlet and/or discharge of the fluid (12) and/or to the fifth passageway (21) for inlet and/or discharge of the fluid (12) and/or to the sixth passageway (22) for inlet and/or discharge of the fluid (12) and/or to the seventh passageway (23) for inlet and/or discharge of the fluid (12) and/or to the eighth passageway (24) for inlet and/or discharge of the fluid (12).

5. A hydrostatic energy generator (100) according to claim 4, wherein the first tank (25) is at least partially arranged around the first chamber (10) and/or around the second chamber (11).

6. A hydrostatic energy generator (100) according to any one of claims 3-5, wherein at least two passageways (15, 16, 17, 18, 21, 22, 23, 24) for inlet and/or discharge of the fluid (12) are connected with each other by connection means (26*a*, 26*b*, 26*c*, 26*d*, 26*e*, 26*f*, 26*g*, 26*h*, 26*i*) wherein the connection means (26*a*, 26*b*, 26*c*, 26*d*, 26*e*, 26*f*, 26*g*, 26*h*, 26*i*) comprise pipes (30*a*, 30*b*, 30*c*, 30*d*, 30*e*, 30*f*, 30*g*, 30*h*, 30*i*, 30*j*, 30*k*, 30*l*) and/or holes internally drilled inside and along chamber walls (33*a*, 33*b*, 33*c*, 33*d*, 33*e*, 33*f*, 33*g*, 33*h*).

7. A hydrostatic energy generator (100) according to any of claims 3-5, wherein the first passageway (15) for inlet and/or discharge of the fluid (12) and/or the second passageway (16) for inlet and/or discharge of the fluid (12) and/or the third passageway (17) for inlet and/or discharge of the fluid (12) and/or the fourth passageway (18) for inlet and/or discharge of the fluid (12) and/or the fifth passageway (21) for inlet and/or discharge of the fluid (12) and/or the sixth passageway (22) for inlet and/or discharge of the fluid (12) and/or the seventh passageway (23) for inlet and/or discharge of the fluid (12) and/or the eighth passageway (24) for inlet and/or discharge of the fluid (12) is/are connected to a supply source.

8. A hydrostatic energy generator (100) according to claim 7, wherein the supply source comprises a static pressure source or a potential energy source.

9. A hydrostatic energy generator (100) according to any of claims 1-5, wherein the first piston (13) comprises a first front side (34) with a first surface area (34*a*) and wherein the first piston (13) comprises a second front side (35) with a second surface area (35*a*) and wherein the first surface area (34*a*) is larger than the second surface area (35*a*), and wherein the second piston (14) comprises a third front side (36) with a third surface area (36*a*) and a fourth front side (37) with a fourth surface area (37*a*), and wherein the fourth surface area (37*a*) is larger than the third surface area (36*a*).

10. A hydrostatic energy generator (100) according to claim 9, wherein the fourth surface area (37*a*) is larger than the first surface area (34*a*), and wherein the third surface area (36*a*) is larger than the second surface area (35*a*).

* * * * *